US005461469A

United States Patent [19]

Farrell et al.

[11] Patent Number: 5,461,469

[45] Date of Patent: Oct. 24, 1995

[54] METHOD OF SETTING-UP A FINISHING APPARATUS

[75] Inventors: Michael E. Farrell, Ontario; Randall R. Hube, Rochester, both of N.Y.

[73] Assignee: Xerox Corporation, Stamford, Conn.

[21] Appl. No.: 169,573

[22] Filed: Dec. 20, 1993

[51] Int. Cl.[6] ..... G03G 15/00

[52] U.S. Cl. ..... 355/321; 270/37; 270/53; 271/288; 355/203; 355/324

[58] Field of Search ..... 355/200, 203, 355/204, 207–208, 209, 308–309, 324, 321–323, 313; 271/278, 288, 289; 395/105, 111, 117; 270/32, 37, 52, 53

[56] References Cited

U.S. PATENT DOCUMENTS

| | | | |
|---|---|---|---|
| 4,611,908 | 9/1986 | Buch | 355/55 |
| 4,727,402 | 2/1988 | Smith . | |
| 4,831,420 | 5/1989 | Walsh et al. | 355/203 |
| 5,032,876 | 7/1991 | Murakami | 355/324 |
| 5,051,781 | 9/1991 | Roehrs et al. | 355/208 |
| 5,053,831 | 10/1991 | Ishiguro et al. | 355/324 |
| 5,105,283 | 4/1992 | Forest et al. | 358/401 |
| 5,109,252 | 4/1992 | Schott, Jr. | 355/202 |
| 5,184,185 | 2/1993 | Rasmussen et al. | 355/308 |
| 5,317,654 | 5/1994 | Perry et al. | 382/61 |
| 5,343,304 | 8/1994 | Nakai et al. | 358/296 |

*Primary Examiner*—A. T. Grimley
*Assistant Examiner*—Thu A. Dang
*Attorney, Agent, or Firm*—Gary B. Cohen

[57] ABSTRACT

There is provided a printing system having a finishing apparatus for receiving and processing a job, with the finishing apparatus having an adjustable finishing component adapted to perform a finishing operation on one or more print media sheets. The printing system includes a controller for receiving a programmed finishing parameter, the programmed finishing parameter indicating a manner in which the job is to be finished. The printing system further includes an actuator for moving the adjustable finishing component in a selected direction. In operation, the controller receives the programmed finishing parameter and converts it into a set-up signal, the set-up signal varying as a function of the programmed finishing parameter. In turn a set-up image is generated with the set-up signal and the set-up image, which includes a target indicator, is used, in conjunction with the actuator, to adjust the adjustable finishing component.

33 Claims, 20 Drawing Sheets

FIG. 20
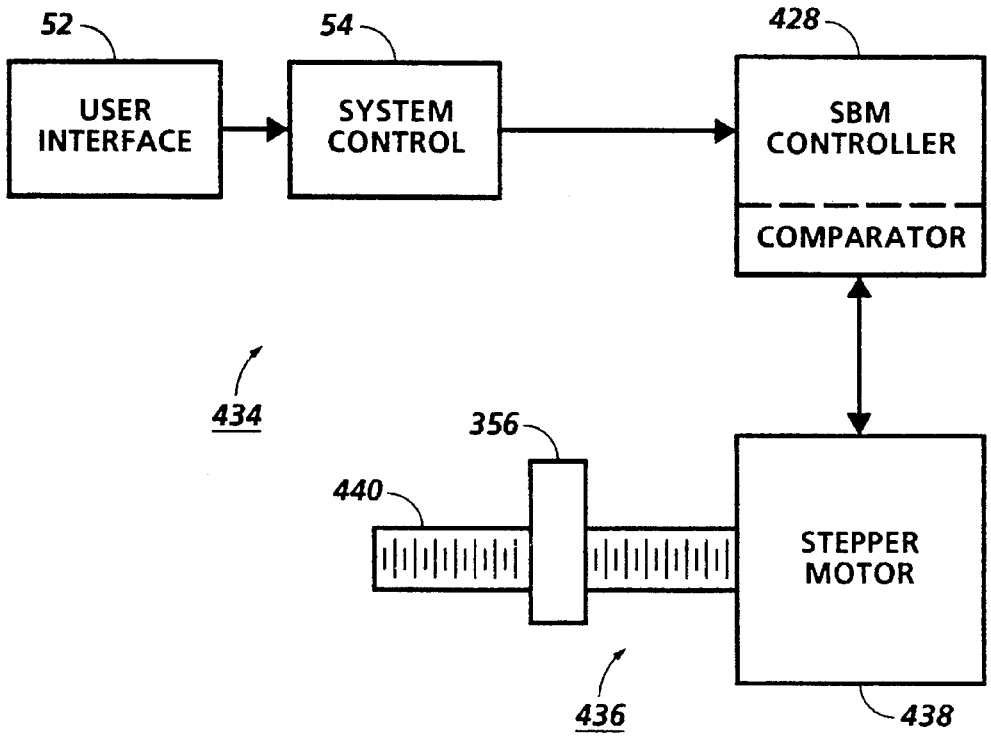
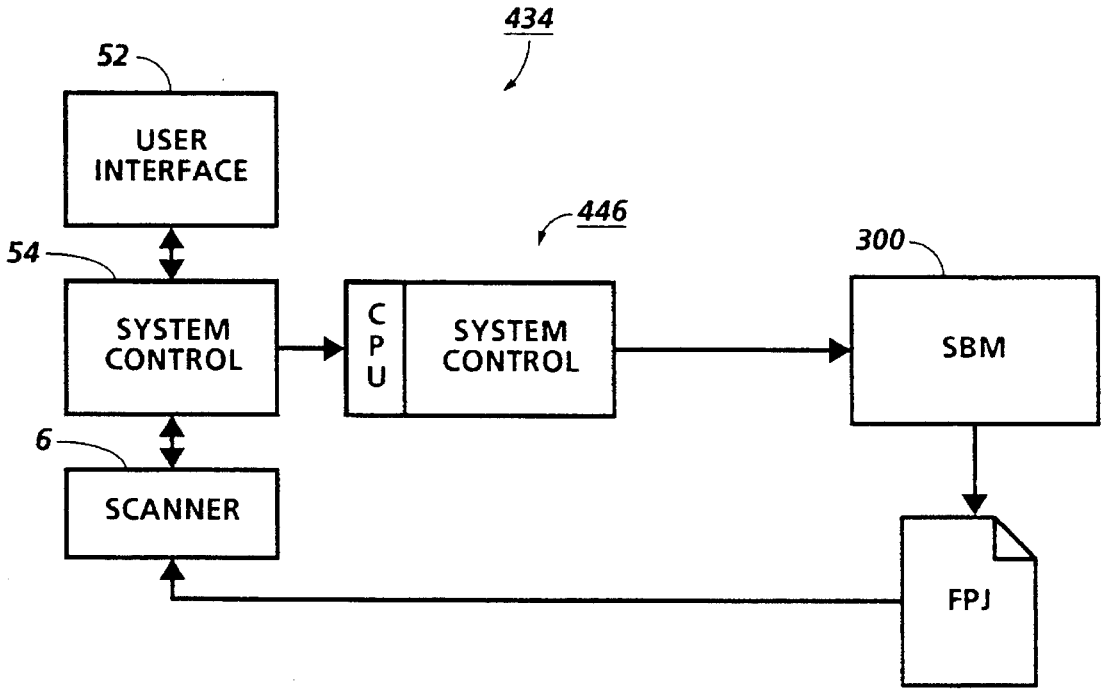
FIG. 21

METHOD OF SETTING-UP A FINISHING APPARATUS

The present invention relates generally to a technique for setting up a finishing apparatus in a printing machine with a programmable printer and, more particularly, for using one or more set-up images (or corresponding set-up prints) to determine if the finishing apparatus is coordinated suitably with respect to the printer so that a job programmed at the printer is finished in a desired fashion at the finishing apparatus.

A common type of job that involves special finishing is one that incorporates signatures. A signature is a sheet containing plural printed pages arranged such that when the sheets are folded and nested in a set, one inside the other, they become one collated booklet. Normally, documents are presented to copiers and printers in page number order, and with only one page on each sheet face. It is generally intended to create booklets having the same page order. If, however, the booklets are formed from folded and nested sheets which each carry four page images (two on the front and two on the back) in their original page sequence, the booklets would contain page images in an illogical order. Accordingly, it is known that a non-sequential placement of image on each signature is essential to providing a finished booklet with a direct sequential page order.

The following references each disclose a technique for creating booklets from documents presented to an electronic printer in page number order:

US-A-4,727,402
Patentee: Smith
Issued: February 23, 1988
US-A-5,105,283
Patentee: Forest et al.
Issued: April 14, 1992
Now Allowed U.S. Pat. Application Ser. No. 07/589,941
Applicants: Rourke et al.
Filed: September 28, 1990

U.S. Pat. No. 4,727,402 discloses a form of signature printing in which the "pages" of "originals" are electronic master images, electronically arranged, rather than normal physical document sheets, physically arranged. The Xerox® "9700" and "8700" electronic laser printers may be operated with automatic signature printing capabilities, referred to as "signature imposition" and specifically as the "Xerox Integrated Composition System" or "XICS", in commercial use since at least March, 1981, as understood.

U.S. Pat. No. 5,105,283 discloses a reproduction apparatus for producing signatures from electrical signals representative of the image content of a plurality of originals to be produced on receiver sheets. The reproduction apparatus includes a multi-image electronic memory having addressable regions for storing such electrical signals defining the image content of a plurality of originals in a first sequence of originals. The address information relating to the storage location of each original is stored in the memory. The stored electrical signals of individual originals are retrieved selectively from the memory in a scheduled order different from the first sequence such that reproduced images of the originals are located on respective sides of receiver sheets in regions such that multiple stacked receiver sheets can be folded between images and nested to form a collated booklet with the pages properly sequenced.

U.S. patent application Ser. No. 07/589,941 ('941 application ") discloses a process for printing signatures in a signature set in an electronic printing system which prints image pages from electronic pages composed of image signals. The system has a source of signature print media sheets for printing pairs of image pages on each side thereof. The process includes, among other steps, a job programming step in which an electronic representation of the print media sheet is displayed for setting the sizes of the images to correspond with the signature set or booklet to be produced.

Signature sets may be developed optimally in a printing system with "on-line finishing" capability, i.e. in a printing system with a finishing apparatus coupled to a printer for receiving and processing the prints produced by the printer. One example of a printing system suited for producing signature sets is sold by Xerox® Corporation and includes a DocuTech® electronic printer coupled with a signature booklet maker ("SBM") manufactured by Bourg Corporation.

The SBM can be constructed, for example, from variants of three existing finishing modules such as the AGR/Automatic Stitcher, the PA/Automatic Folder, and the TR/Automatic Trimmer, manufactured by C. P. Bourg for off-line use. All modules require mechanical modification to support front edge registration vs. center registration and wiring modification to share basic signals with the printer. The printer exports sheet arrival times and end-of-set signals to the SBM equipment. The first module receives and aligns the copy sheets in a set (which set forms a single booklet) so that all sheets in the set are aligned with one another. The first module aligns each sheet by stopping the forward movement of the sheet (e.g., with a gate or sheet stop), and then laterally tapping each sheet against another sheet stop. Once all sheets in the set are received and aligned, the first module stitches or binds all the sheets in the set to each other at a central location (between each page image on each sheet). The stitching step can comprise, for example, stapling. Thus, the first module is referred to as a "saddle stitcher."

The stitched copy set is then forwarded to a second module which folds the stitched copy set in half about the stitch axis or foldline. Thus, the second module is referred to as a "folder."

The folded copy set is then forwarded to a third module where the edges of the sheets opposite from the fold are trimmed. Thus, the third module is referred to as a "trimmer." Trimming is necessary, particularly in large sets or booklets, because the edges of the sheets opposite from the fold become uneven after folding.

Further details regarding the SBM is provided in the following patent:

US-A-5,184,185
Patentees: Rasmussen et al.
Issued February 2, 1993

In the above-mentioned printing system, which preferably employs the programming arrangement of the '941 application, the finisher is adjusted to accommodate for the particular finishing parameters of a job. Typically, adjustments, to the SBM, are required each time paper sizes and/or the position of a finishing operation on a sheet is changed.

The following patent relates to an automatic registration system for a copier:

US-A-4,831,420
Patentees: Walsh et al.
Issued: May 16, 1989

U.S. Pat. No. 4,831,420 discloses a system for setting or adjusting the proper registration position of the original documents in a copier having a document feeder providing a variable document registration position on the platen, and numeric data key entries in specialized diagnostic modes, and non-volatile memory. The system involves registering and copying a test sheet using the document feeder in its initial, unadjusted, registration setting. The test sheet has a test pattern of registration position indicia with identifying numeric indicia, and also includes a registration window at an optically reversed position on the test sheet from the test pattern and a cursor pointing to a specific position within the window. The test sheet is laid over a same-size copy of the test sheet, with the sheet edges aligned, but with the two sheets rotated by 180° relative to one another, so that the copy of the test pattern on the copy sheet underlies and is visible through the registration window of the test sheet, whereby the cursor on the test sheet points to a specific registration identifying numeric indicia within the test pattern copy. The copier resets in non-volatile memory the registration position of the document feeder based upon an operator entering the identifying numeric indicia into the numeric data key entries of the copier.

As a given finishing parameter, such as trim size, is varied to any significant degree, a component of the SBM, such as the automatic trimmer, must be adjusted to accommodate for such variation. In one example of SBM adjustment, a machine operator makes a proof set of a signature job, measures the trimmed booklet width, calculates the amount trimmed, compares the measured value to the specified trim, adjusts the trimming mechanism and repeats the process if necessary. This procedure can be undesirable in that it is difficult to make the trim measurement with any great precision. Problems associated with adjusting the SBM are not limited to adjusting the automatic trimmer. In other examples, it may be necessary to change paper sheet registration in the automatic folder for purposes of folding a plurality of signatures along a desired fold line and/or reposition the automatic stitcher for applying stitches at an appropriate location in the booklet. It would be desirable to provide the operator with a "tool" that facilitates the process of adjusting an on-line finishing arrangement to correspond, in operation, with the printer. Moreover, it would be desirable to provide a printing system with an on-line finishing arrangement in which evaluation of SBM (or finisher) performance and/or adjustment(s) could be performed automatically.

One embodiment of the DocuTech® electronic printing system includes stitch heads coupled with a controller, which controller communicates with a user interface. In response to input from the user interface, the controller is adapted to position the stitch heads. Additionally, information regarding the respective positions of the stitch heads, relative to an electronic representation of a print media sheet can be displayed. An operator can use the displayed information, regarding stitch head position, to set the corresponding positions of the stitch heads. Setting stitch heads under this approach is not always straightforward, particularly for less experienced operators executing more complicated jobs, such as signature jobs, and time could be saved by providing the operator with a set-up image that indicates, for all types of jobs, where the optimum stitch positions exist.

In accordance with one aspect of the disclosed embodiment of the present invention there is provided a printing system having a finishing apparatus for receiving and processing a job, the finishing apparatus having an adjustable finishing component for performing a finishing operation on one or more print media sheets, including: a controller for receiving a programmed finishing parameter which indicates a manner in which the job is to be finished, said controller converting the programmed finishing parameter into a set-up signal, the set-up signal varying as a function of the programmed finishing parameter; means for generating a set-up image with the set-up signal, the set-up image including a representation of a target indicator, the representation of the target indicator varying as a function of the programmed finishing parameter; and means for adjusting the adjustable finishing component with the set-up image.

In accordance with another aspect of the disclosed embodiment of the present invention there is provided a method of controlling a printing system having a finishing apparatus for receiving and processing a job, the finishing apparatus having an adjustable finishing component adapted to perform a finishing operation on one or more print media sheets, including the steps of: converting a programmed finishing parameter, indicating a manner in which a job is to be finished, into a set-up signal, the set-up signal varying as a function of the programmed finishing parameter; generating a set-up image with the set-up signal, the set-up image including a representation of a target indicator, the representation of the target indicator varying as a function of the programmed finishing parameter; and adjusting the adjustable finishing component with the set-up image.

In accordance with yet another aspect of the disclosed embodiment of the present invention there is provided a method of controlling a printing system having a finishing apparatus for receiving and processing a job, the finishing apparatus having an adjustable finishing component adapted to perform a finishing operation on a plurality of print media sheets, including the steps of: programming the printing system with a first finishing parameter value representative of a first finishing operation to be performed on a first job; storing the first finishing parameter value; programming the printing system with a second finishing parameter value representative of a second finishing operation to be performed on a second job; determining a difference between the first finishing parameter value and the second finishing parameter value; and adjusting the adjustable finishing component when the difference between the first finishing parameter value and the second finishing parameter value is greater than a preselected reference value.

These and other aspects of the invention will become apparent from the following description, the description being used to illustrate a preferred embodiment of the invention when read in conjunction with the accompanying drawings.

Figure 1:
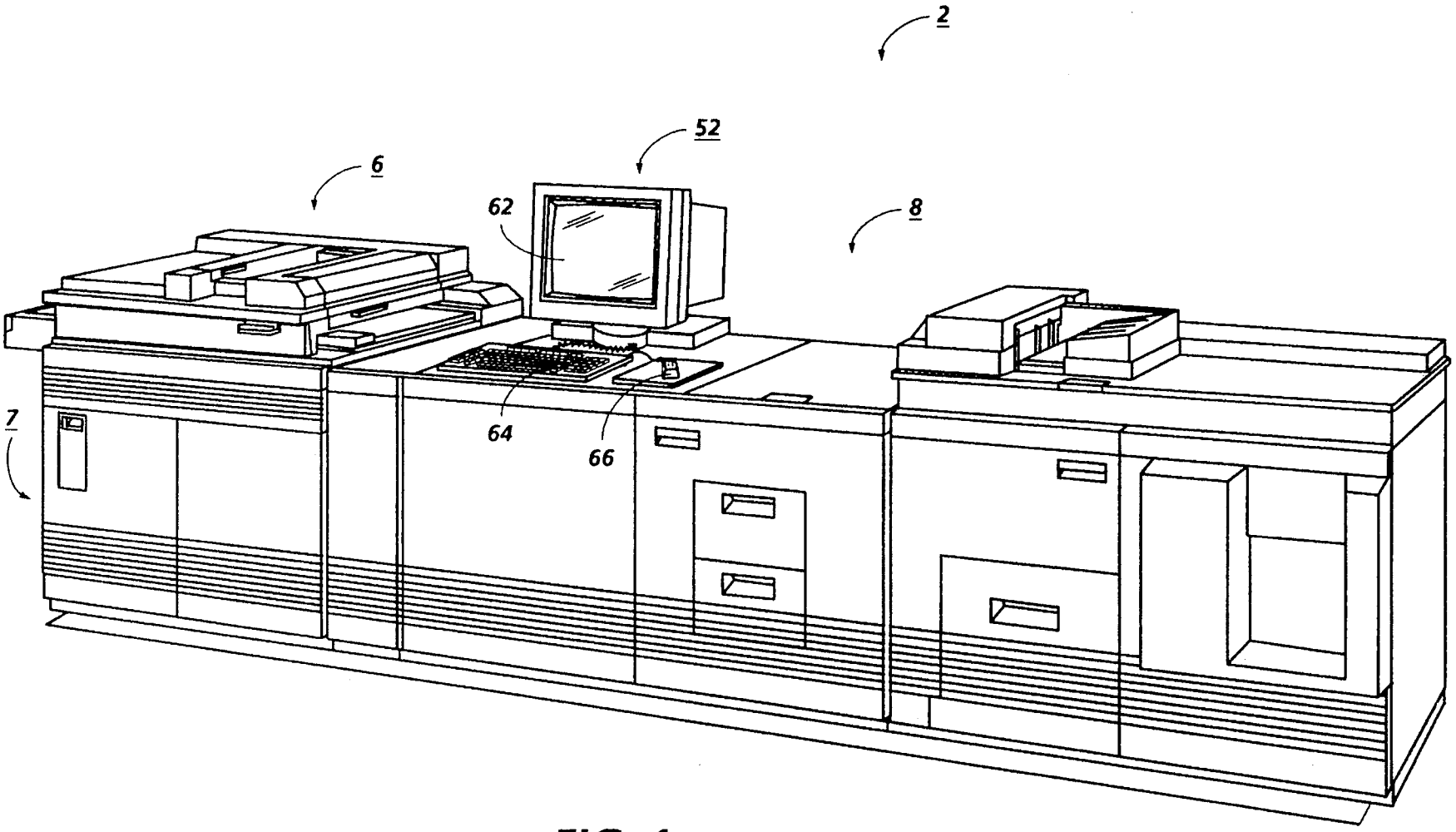
FIG. 1 is a view depicting an electronic printing system for printing signatures.
Figure 2:
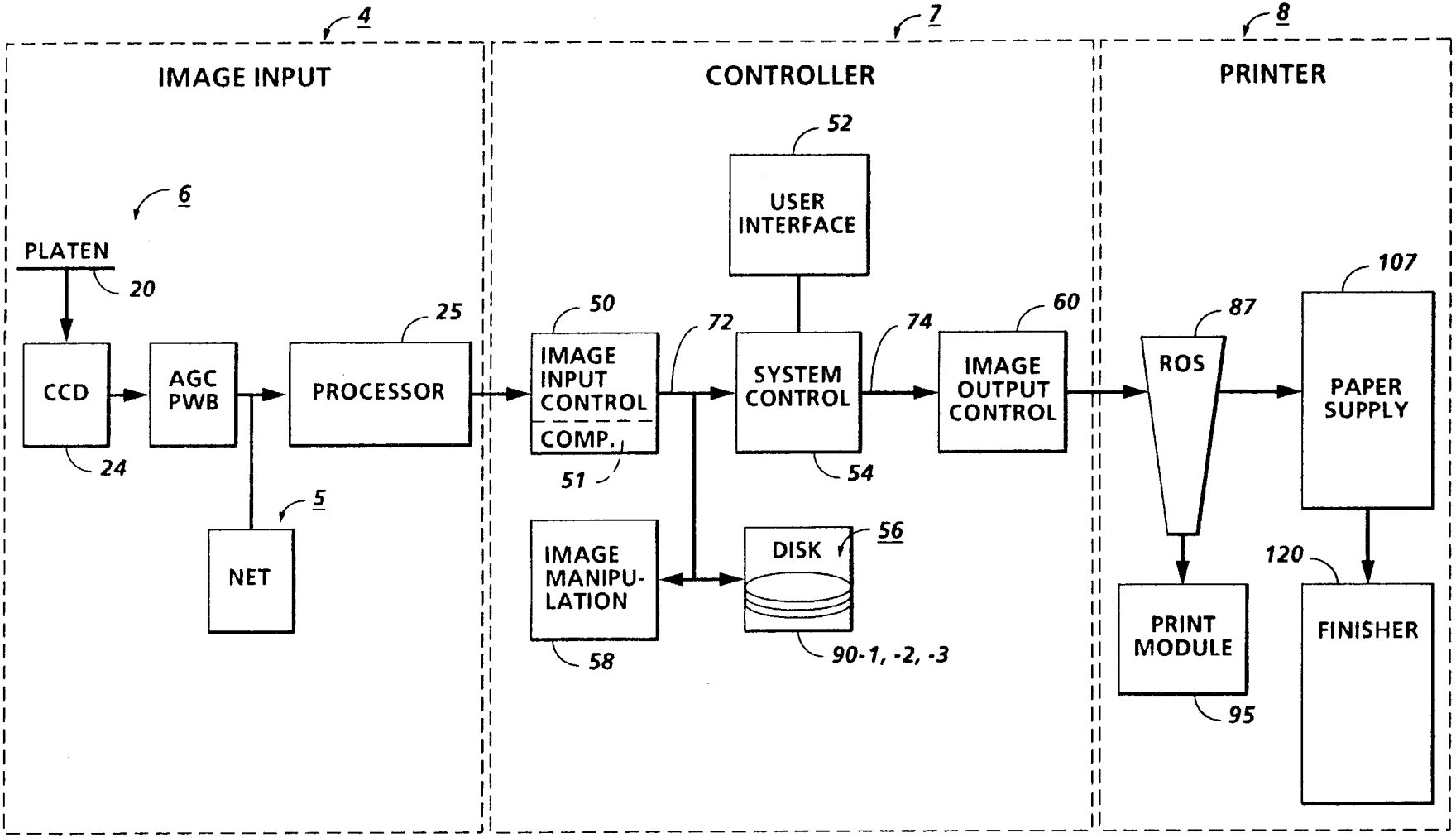
FIG. 2 is a block diagram depicting the major elements of the printing system shown in FIG. 1.
Figure 5:
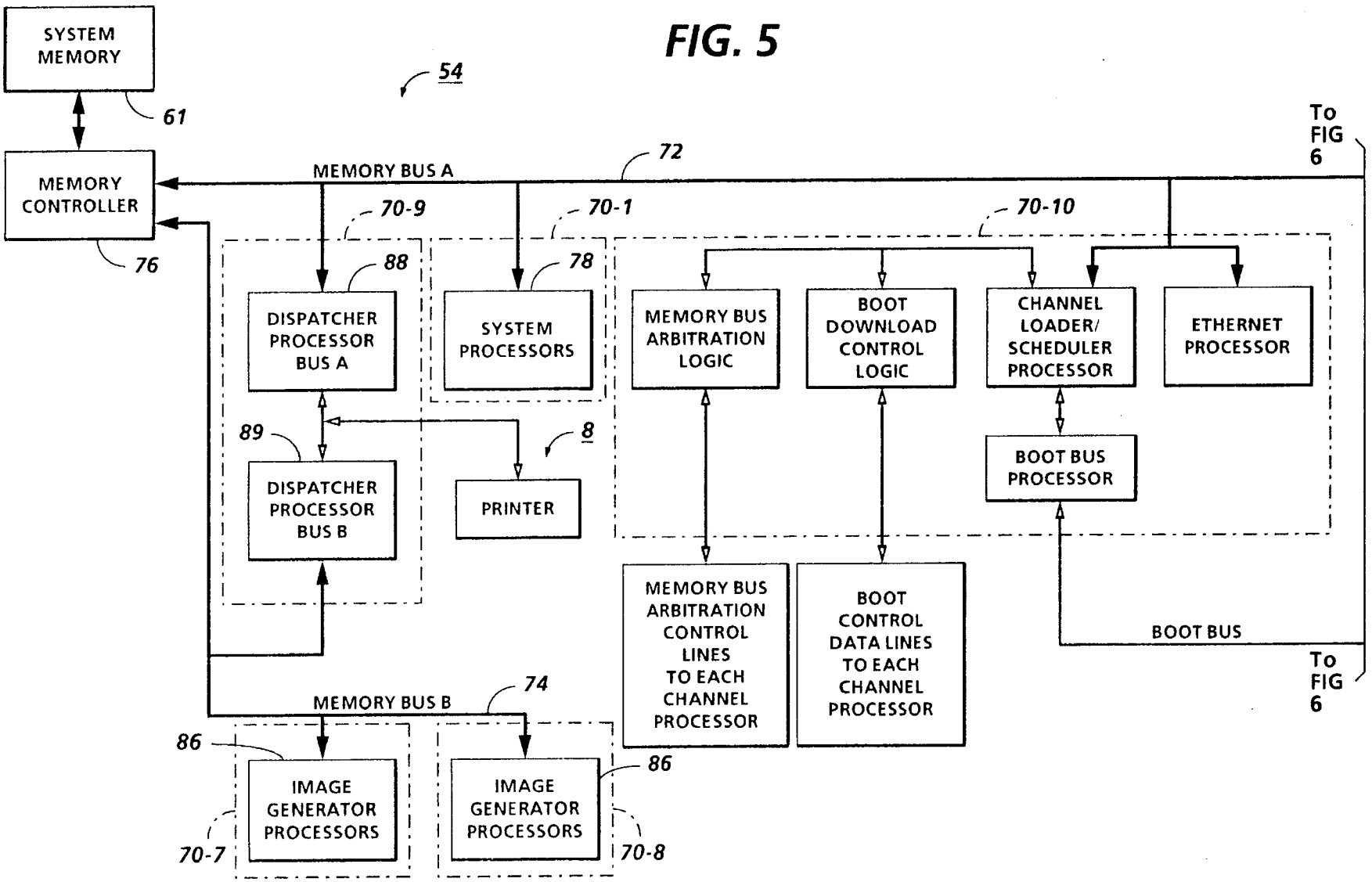
Figure 6:
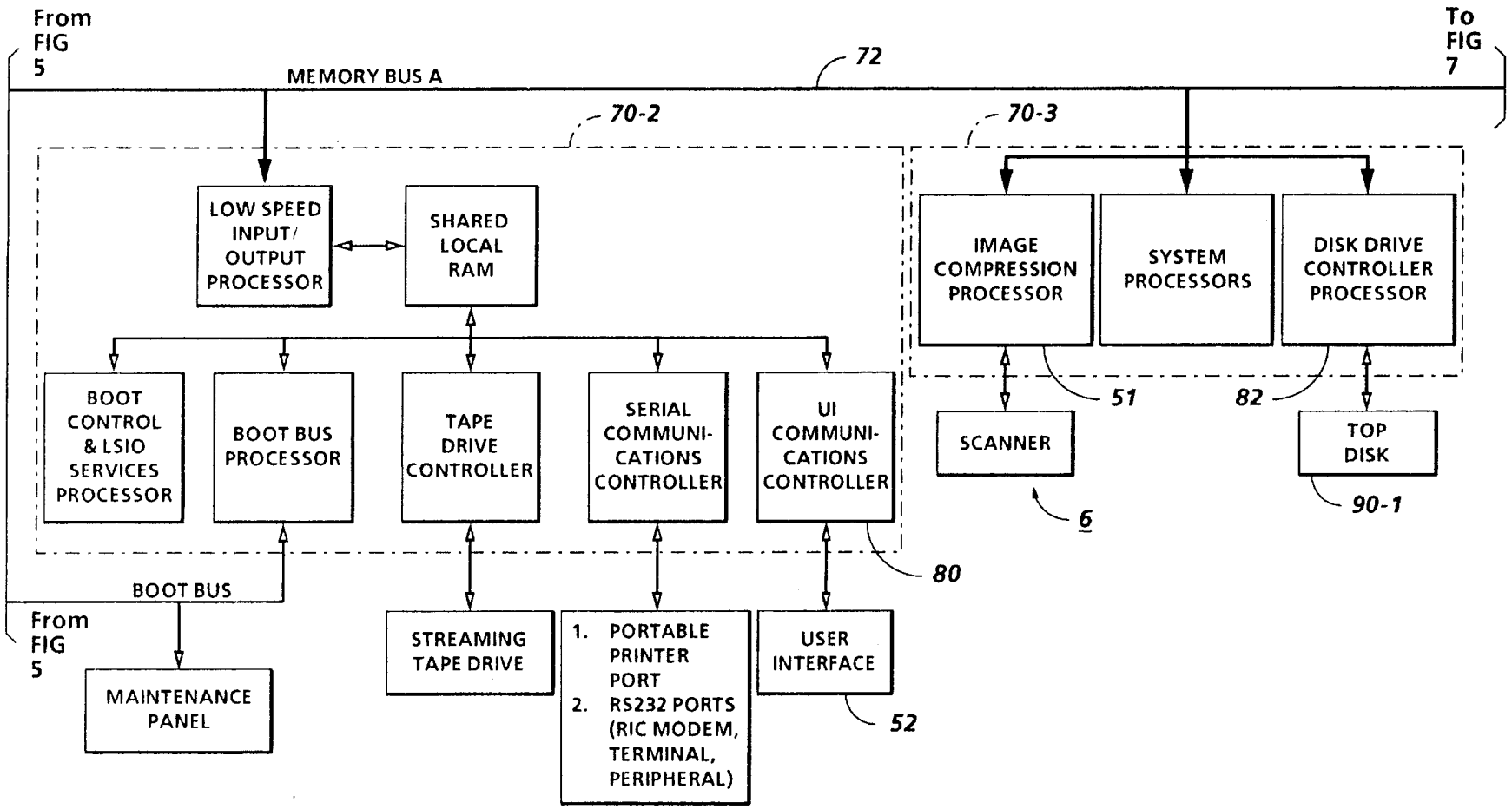
Figure 7:
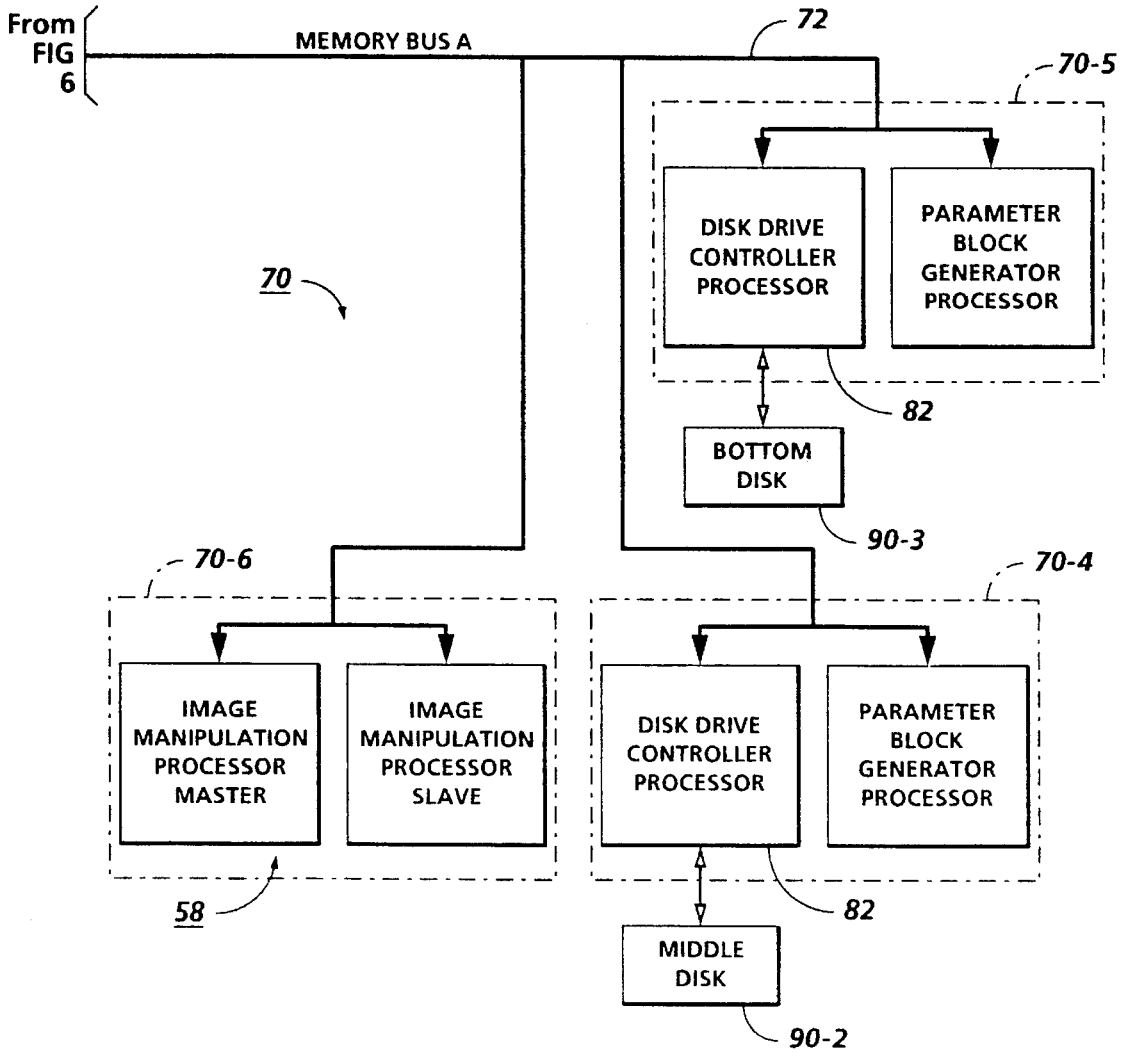
Figure 8:
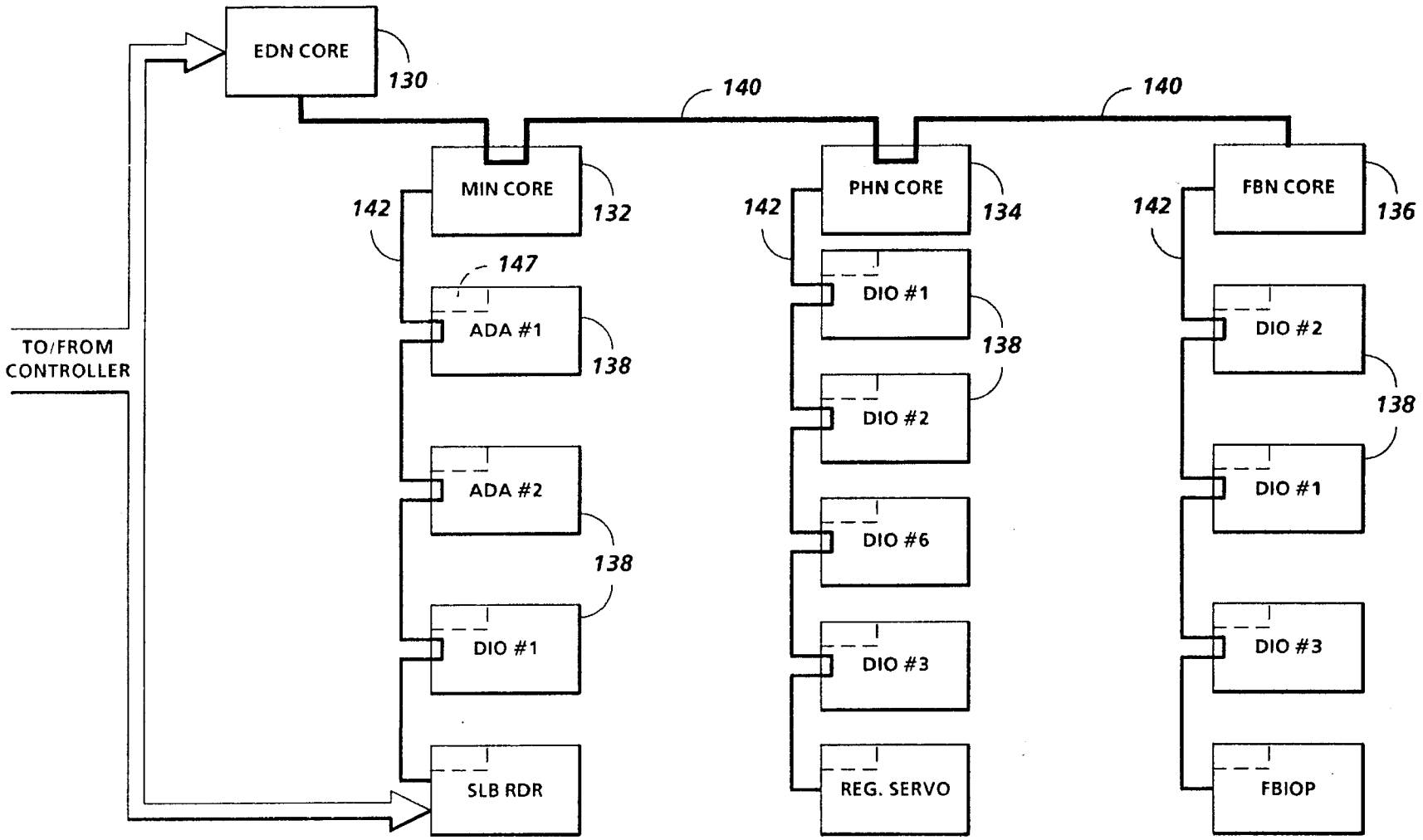
Figure 9:
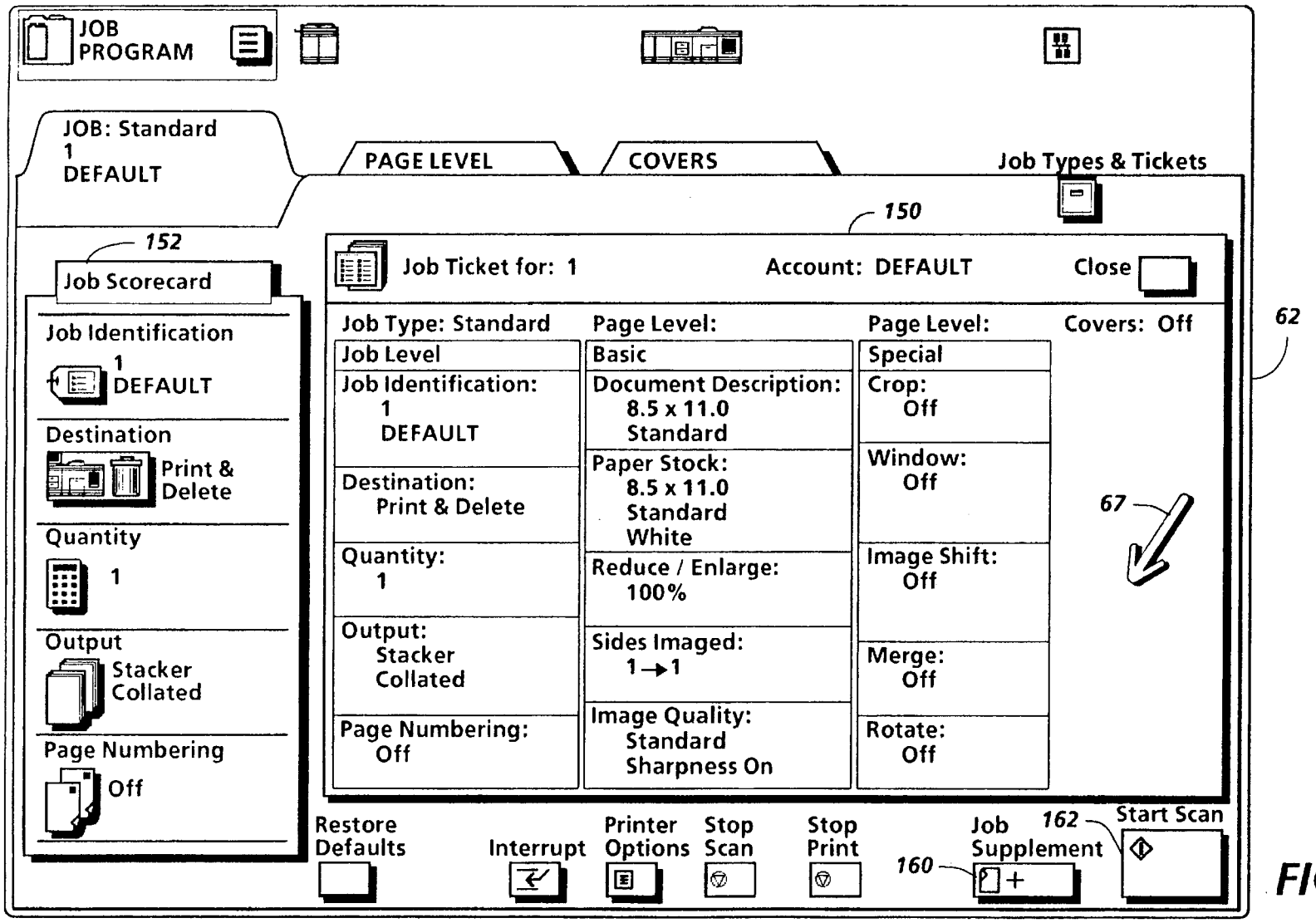
Figure 11:
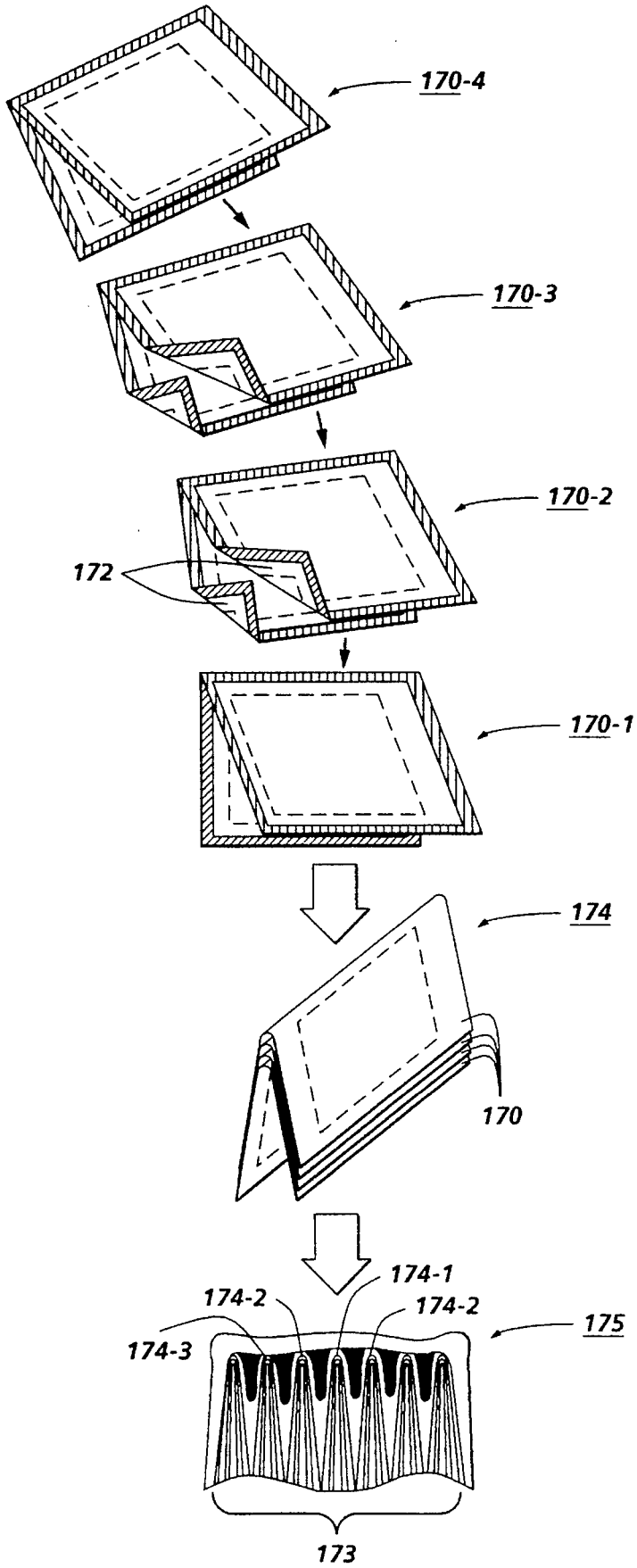
Figure 12:
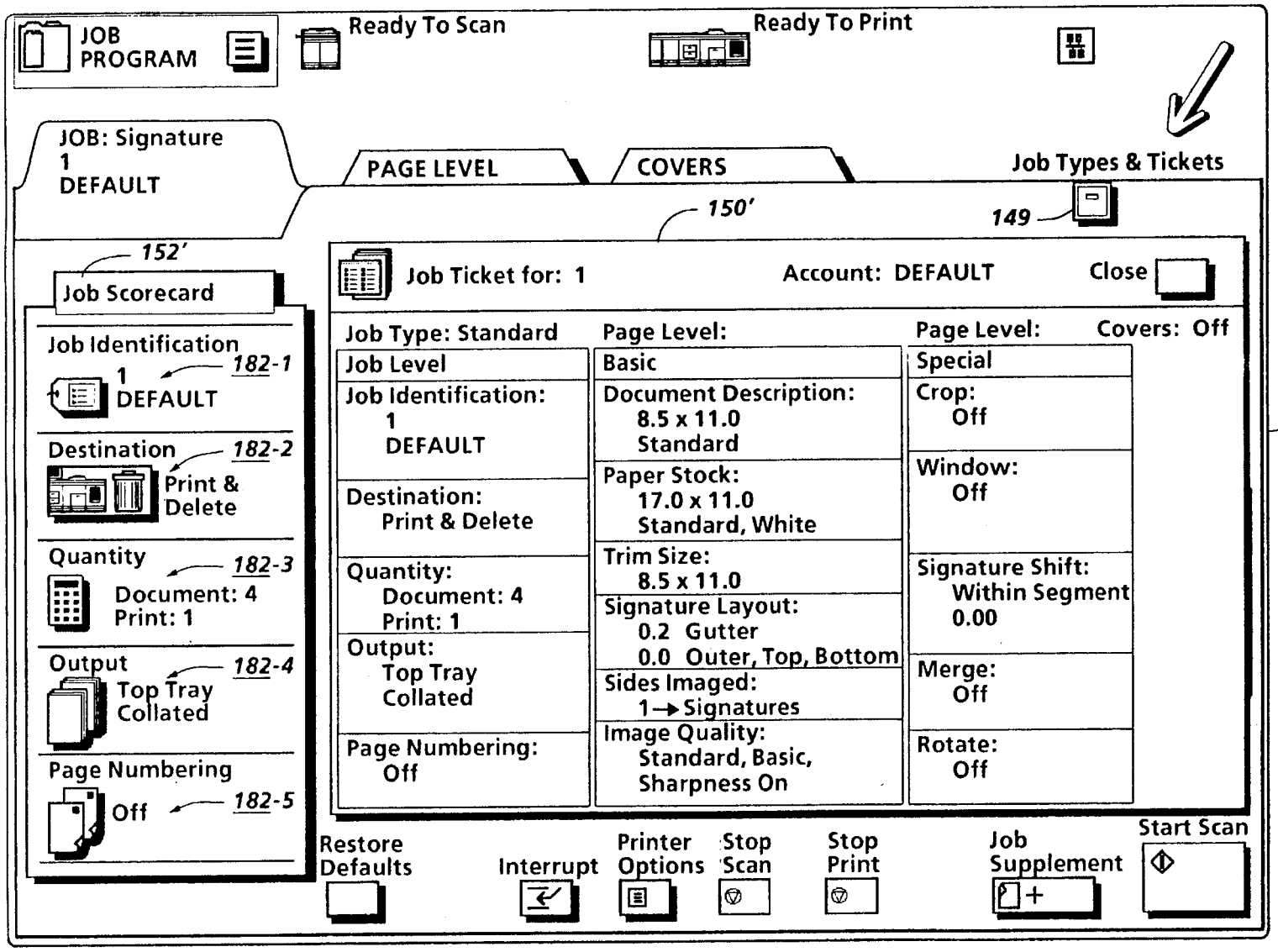
Figure 13:
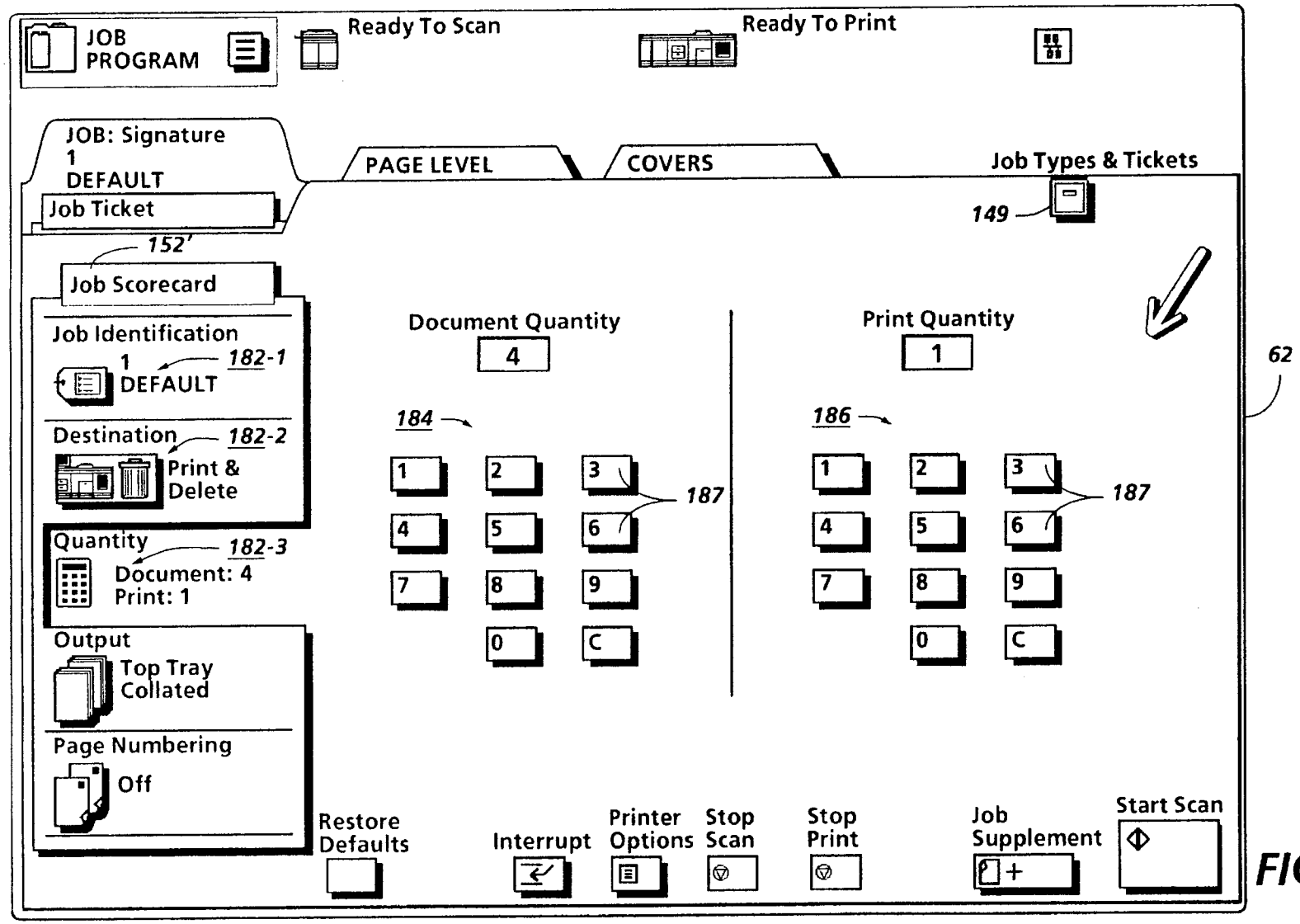
Figure 14:
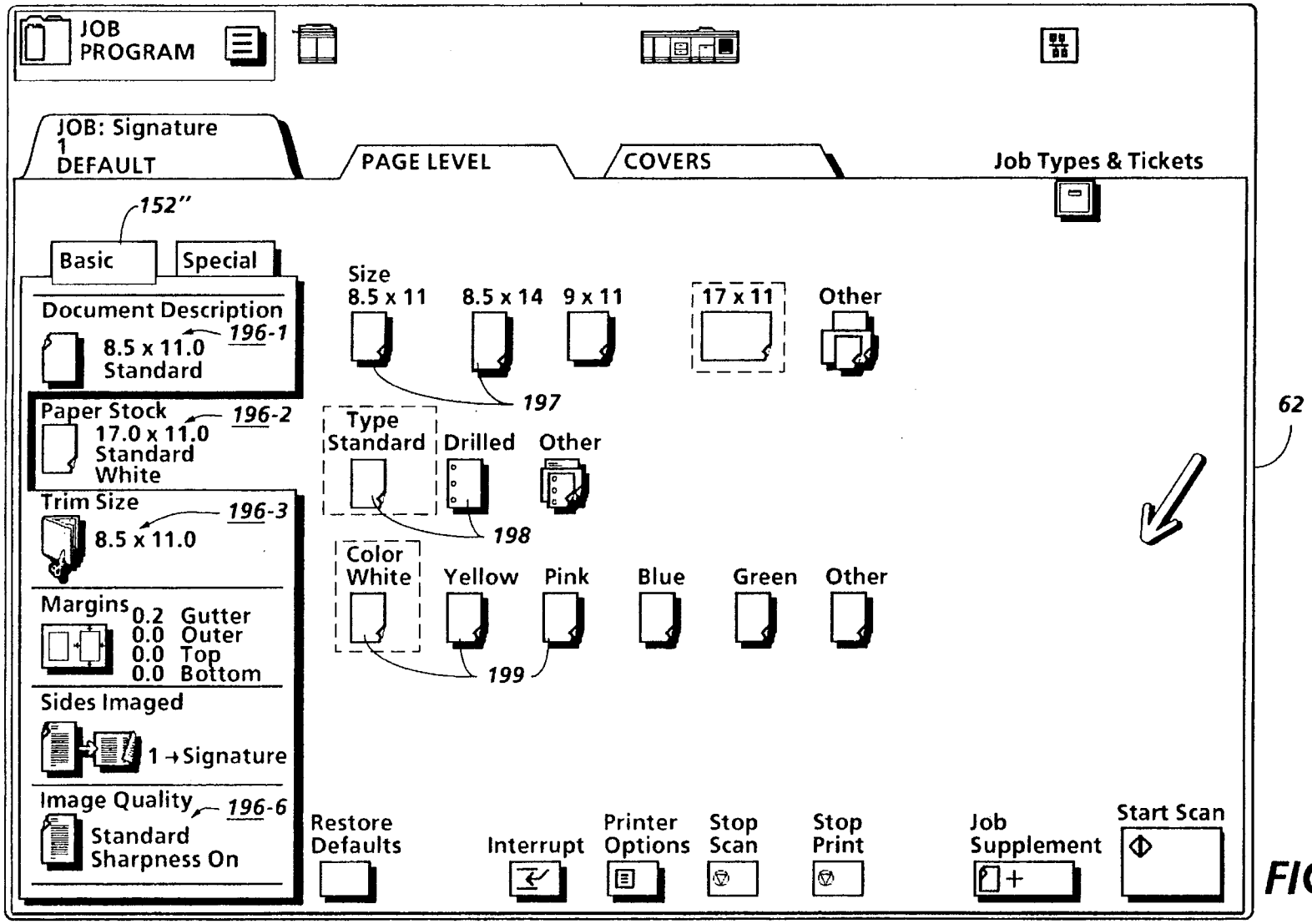
Figure 15:
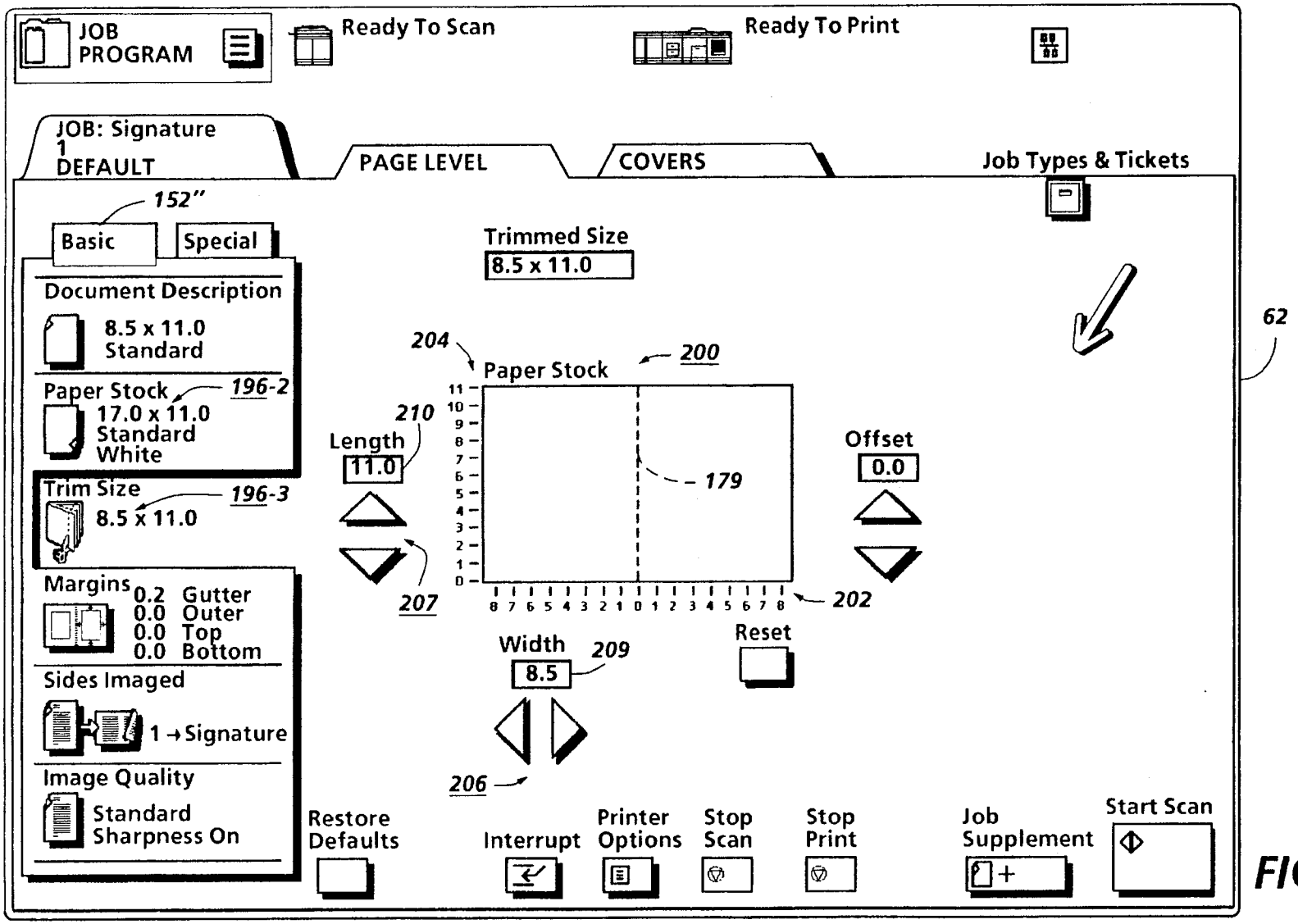
Figure 16:
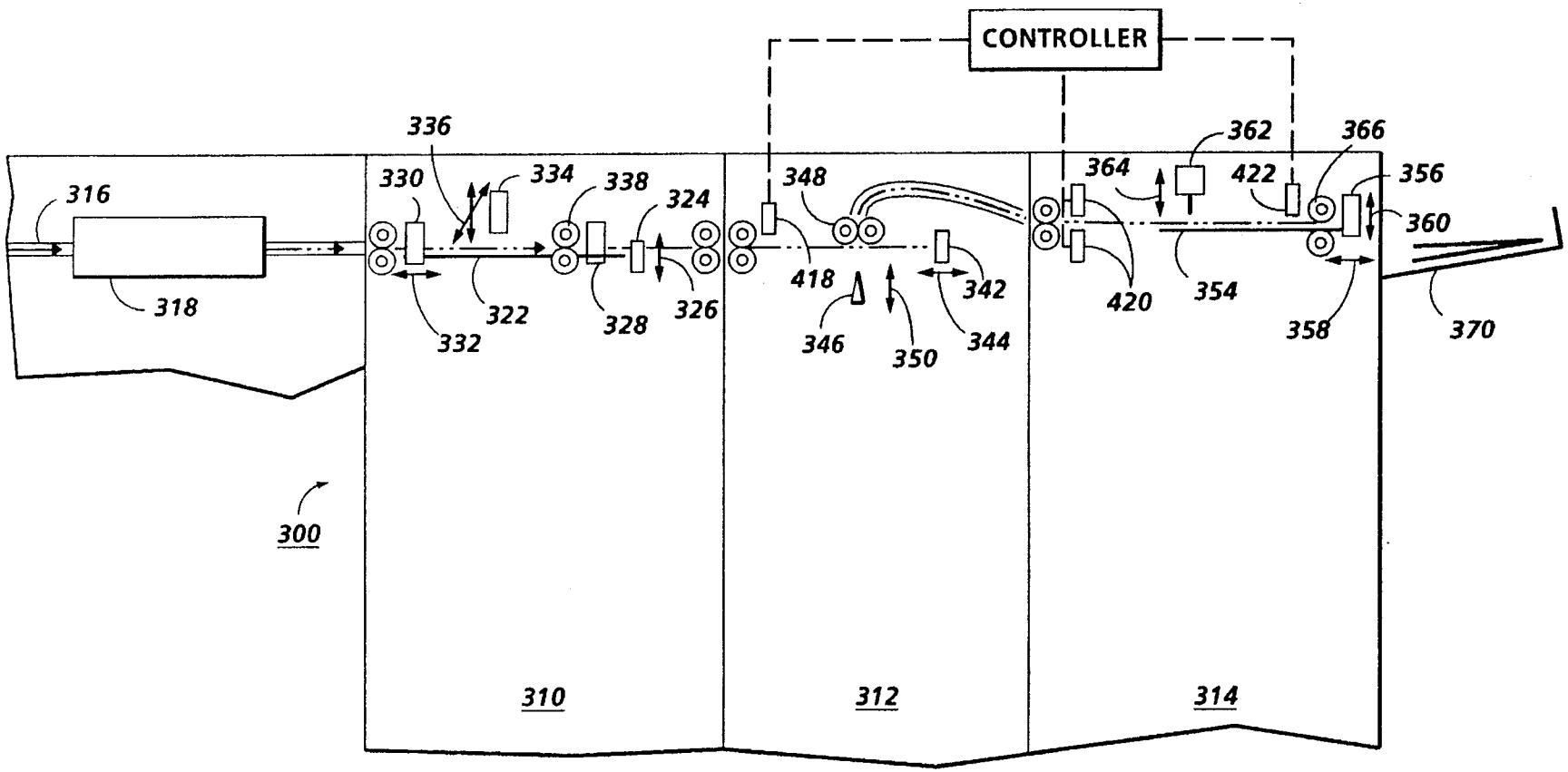

FIGS. 5–7 comprise a schematic block diagram showing the major parts of the control section for the printing system shown in FIG. 2;

FIG. 8 is a block diagram of an Operating System, together with Printed Wiring Boards and shared line connections for the printing system shown in FIG. 1;

FIG. 9 is a view depicting the system User Interface (UI) touchscreen display showing an electronic Job Ticket and Job Scorecard of the type used to program print jobs on the printing system shown in FIG. 1;

FIGS. 10A–10D are views depicting a step by step process for readying of a signature job for printing;

FIG. 11 is an isometric view showing formation of a signature segment and book;

FIG. 12 is a view depicting a "Signature" Job Ticket and "Job Scorecard" for use in programming a signature job;

FIG. 13 is a view of the touchscreen display depicting program options for selecting signature quantity;

FIG. 14 is a view of the touchscreen display depicting program options for selecting signature Paper Stock;

FIG. 15 is a view of the touchscreen display depicting program options for selecting signature Trim size;

FIG. 16 is an elevational, schematic view depicting a signature booklet maker.

Figure 17:
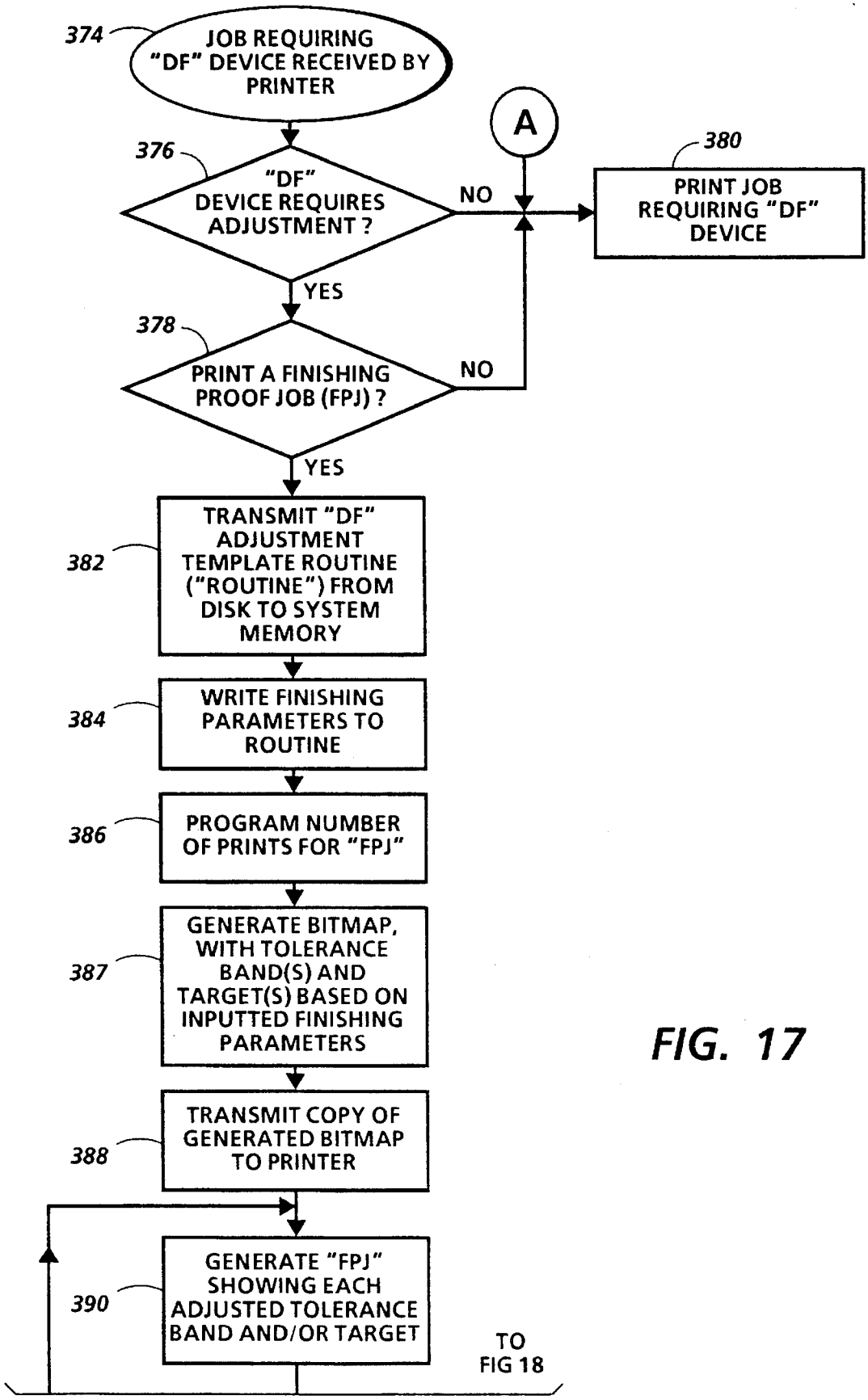
Figure 18:
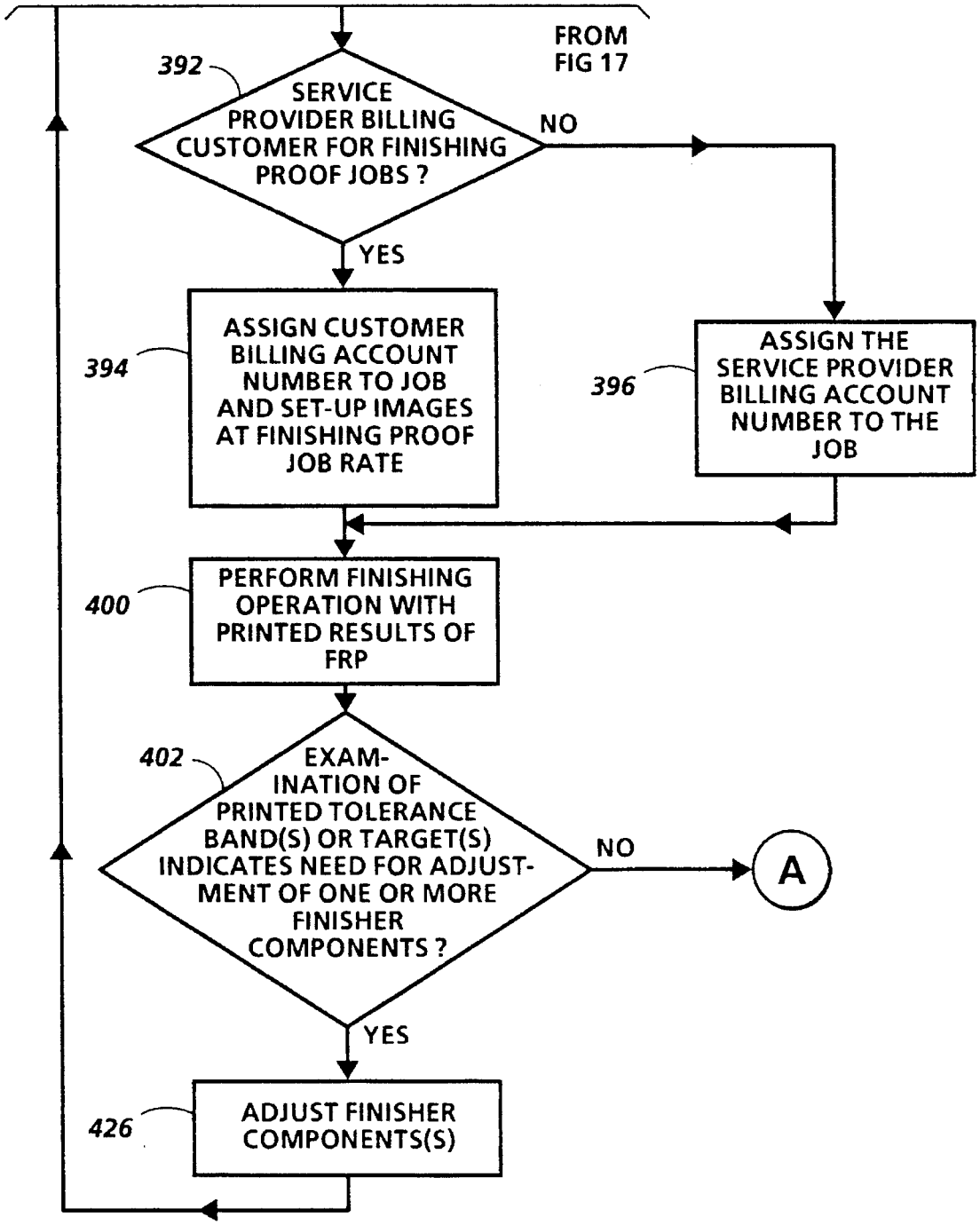
Figure 19:
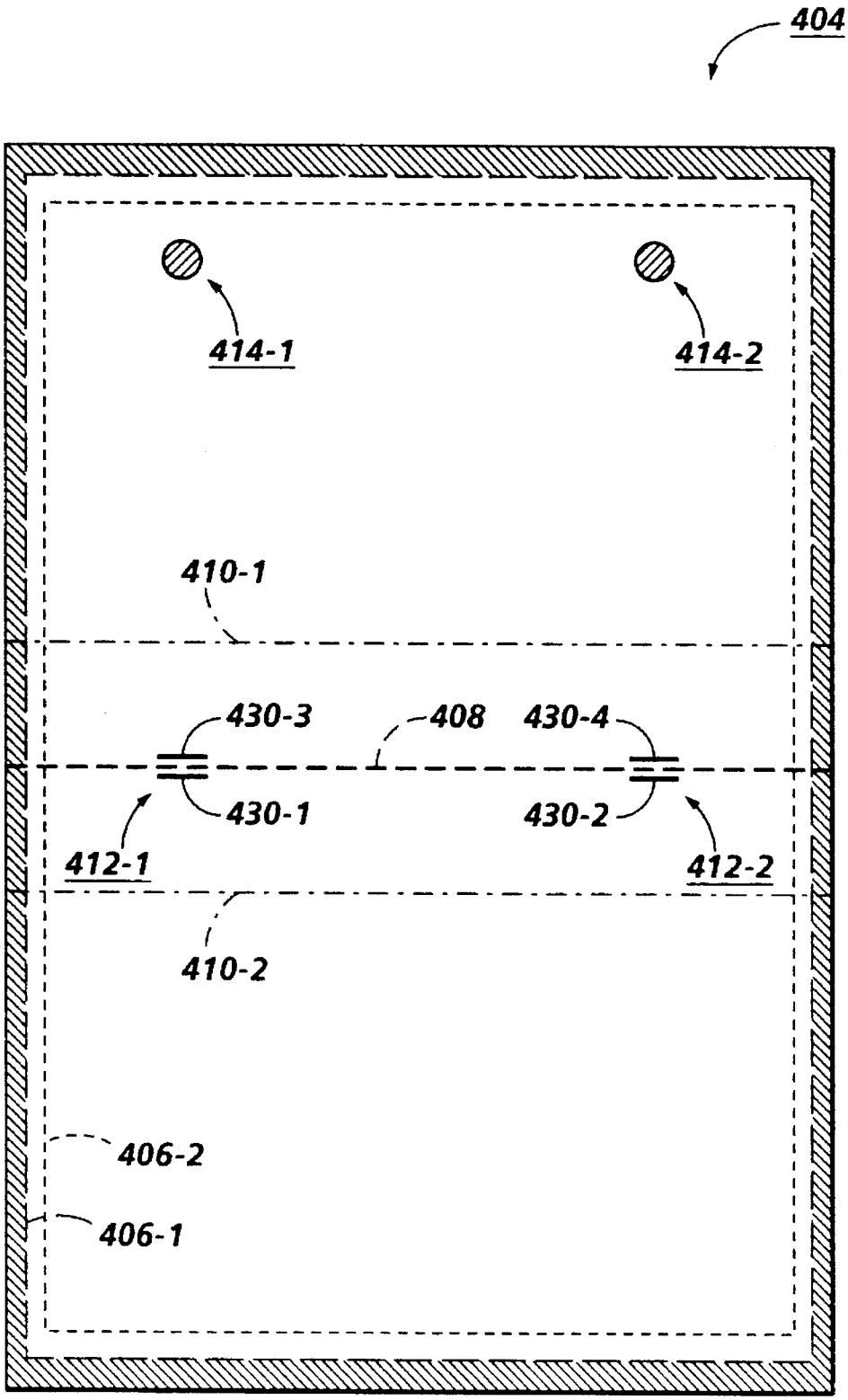

FIGS. 17 and 18 is a flow diagram depicting the process employed in generating set-up images (i.e. a finishing proof job) for use in the SBM and adjusting the SBM with the finishing proof job;

FIG. 19 is a schematic, elevational view of one of the set-up images generated with the process of FIGS. 17–18;

FIG. 20 is a block diagram of a first embodiment of a system for adjusting and calibrating the SBM automatically; and FIG. 21 is a block diagram of a second embodiment of a system for adjusting and calibrating the SBM automatically.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Referring to FIGS. 1 and 2, there is shown an exemplary image printing system 2 for processing print jobs including signature print jobs in accordance with the teachings of the present invention. Printing system 2 for purposes of explanation is divided into image input section 4, controller section 7, and printer section 8. In the example shown, image input section 4 has both remote and on-site image inputs, enabling system 2 to provide network, scan, and print services. Other system combinations may be envisioned such as a stand alone printing system with on-site image input (i.e., a scanner), controller, and printer; a network printing system with remote input, controller, and printer; etc. While a specific printing system is shown and described, the present invention may be used with other types of printing systems. For example, printer section 8 may instead use a different printer type such as ink jet, ionographic, etc.

Figure 3:
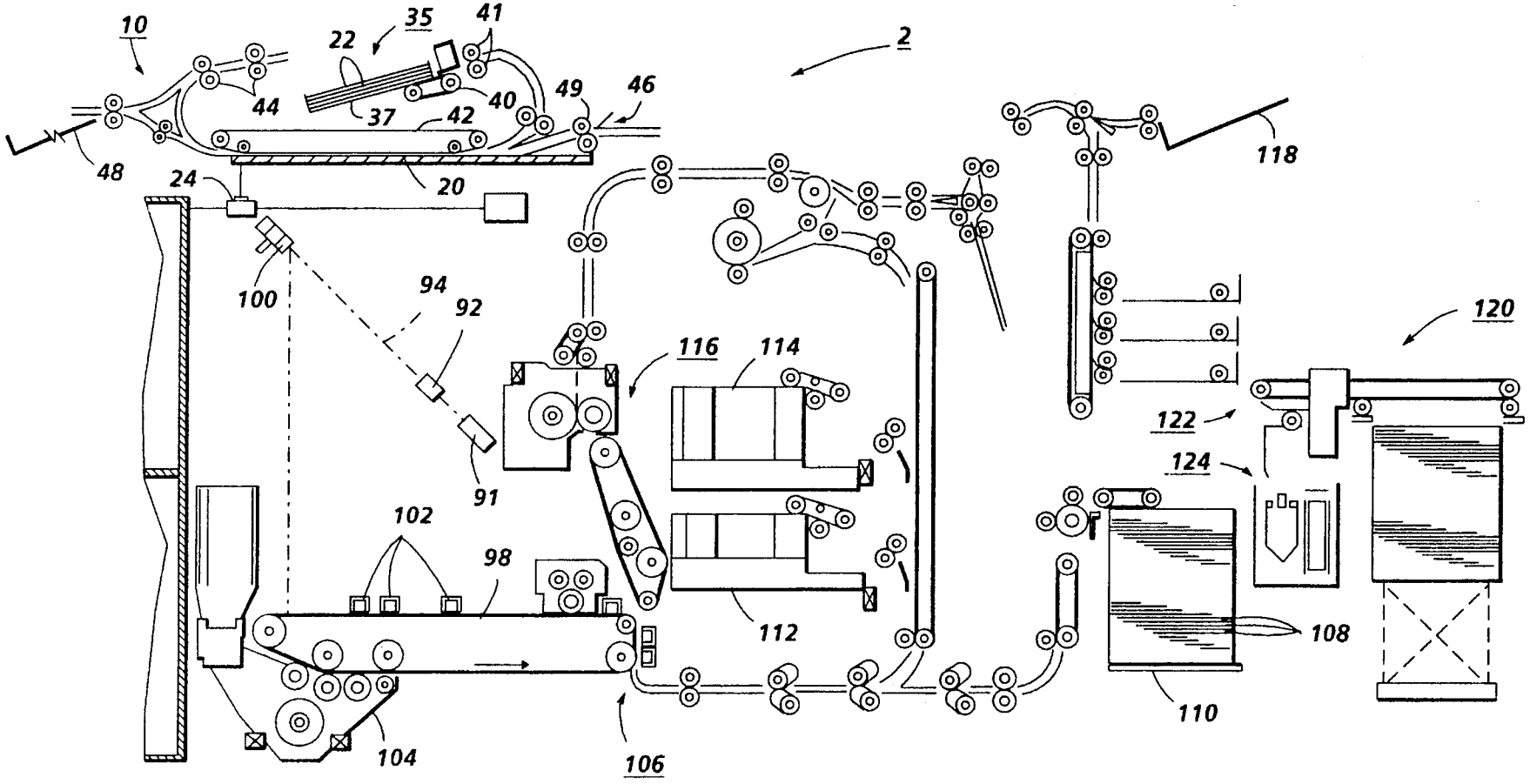
FIG. 3 is an elevational view illustrating the principal mechanical components of the printing system shown in FIGS. 1 and 2.
Figure 4:
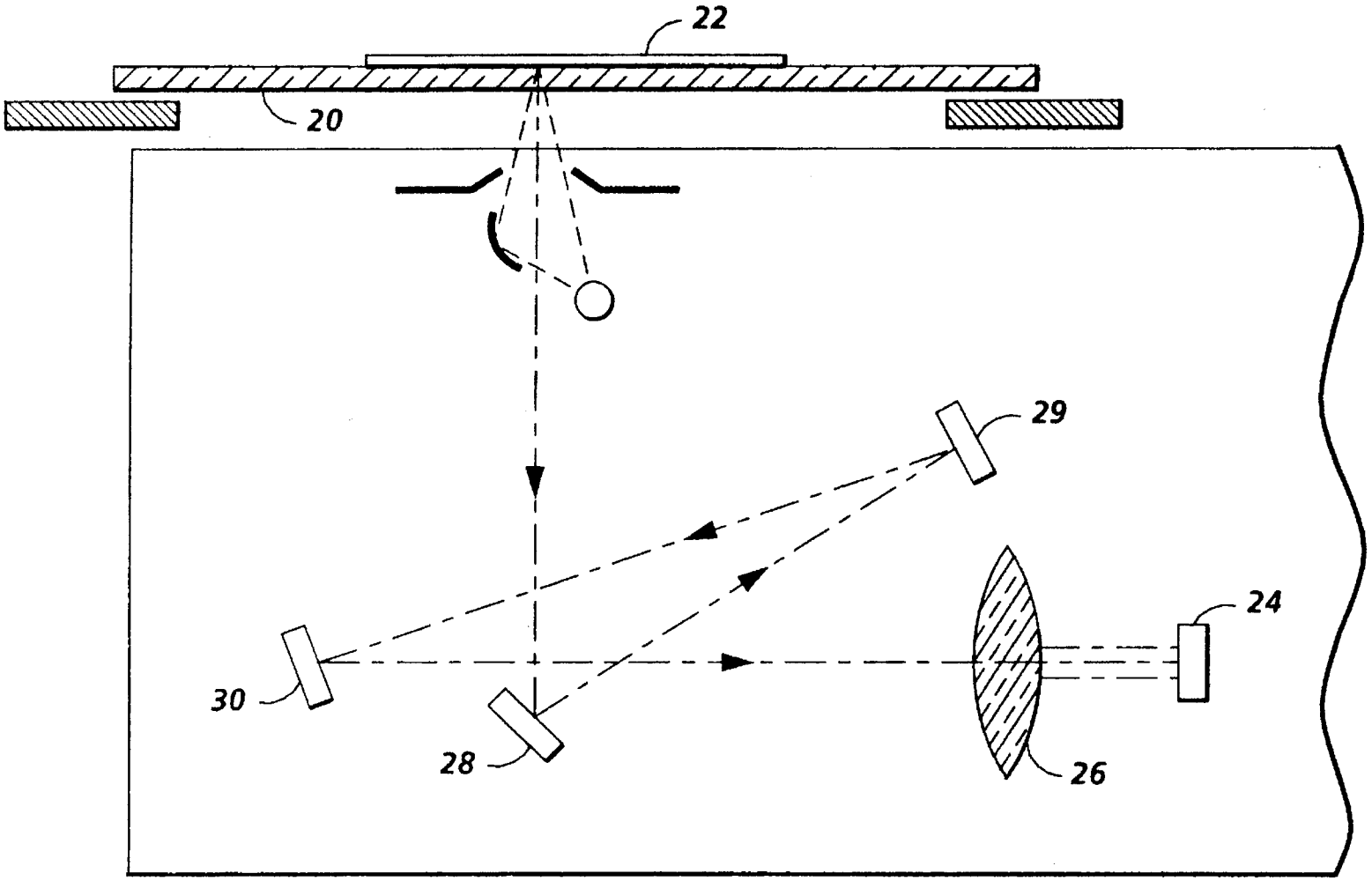
FIG. 4 is a schematic view showing certain construction details of a document scanner for the printing system shown in FIGS. 1 and 2.

Referring particularly to FIGS. 2–4, for off-site image input, image input section 4 has a network 5 with a suitable communication channel such as a telephone line enabling image data in the form of image signals or pixels from one or more remote sources to be input to system 2 for processing. Where the Page Description Language (PDL) of the incoming imaging data is different than the PDL used by system 2, suitable conversion means (not shown) are provided. Other remote sources of image data such as streaming tape, floppy disk, etc. may be envisioned.

For on-site image input, section 4 has a document scanner 6 with a transparent platen 20 on which documents 22 to be scanned are located. One or more linear arrays 24 are supported for reciprocating scanning movement below platen 20. Lens 26 and mirrors 28, 29, 30 cooperate to focus array 24 on a line like segment of platen 20 and the document being scanned thereon. Image data in the form of image signals or pixels from net 5 or array 24 are input to processor 25 for processing. After processing, the image signals are output to controller section 7.

Processor 25 converts the analog image signals output by array 24 to digital. Processor 25 further processes image signals as required to enable system 2 to store and handle the image data in the form required to carry out the job programmed. Processor 25 also provides enhancements and changes to the image signals such as filtering, thresholding, screening, cropping, scaling, etc.

Documents 22 to be scanned may be located on platen 20 for scanning by automatic document handler (ADF) 35 operable in either a Recirculating Document Handling (RDH) mode or a Semi-Automatic Document Handling (SADH) mode. A manual mode including a Book mode and a Computer Forms Feeder (CFF) mode are also provided, the latter to accommodate documents in the form of computer fanfold. For RDH mode operation, document handler 35 has a document tray 37 in which documents 22 are arranged in stacks or batches. The documents 22 in tray 37 are advanced by vacuum feed belt 40 and document feed rolls 41 and document feed belt 42 onto platen 20 where the document is scanned by array 24. Following scanning, the document is removed from platen 20 by belt 42 and returned to tray 37 by document feed rolls 44.

For operation in the SADH mode, a document entry slot 46 provides access to the document feed belt 42 between tray 37 and platen 20 through which individual documents may be inserted manually for transport to platen 20. Feed rolls 49 behind slot 46 form a nip for engaging and feeding the document to feed belt 42 and onto platen 20. Following scanning, the document is removed from platen 20 and discharged into catch tray 48.

For operation in the CFF mode, computer forms material is fed through slot 46 and advanced by feed rolls 49 to document feed belt 42 which in turn advances a page of the fanfold material into position on platen 20.

Referring to FIGS. 2 and 3, printer section 8 comprises a laser type printer and for purposes of explanation is separated into a Raster Output Scanner (ROS) section 87, Print Module Section 95, Paper Supply section 107, and Finisher 120. ROS 87 has a laser 91, the beam of which is split into two imaging beams 94. Each beam 94 is modulated in accordance with the content of an image signal input by acousto-optic modulator 92 to provide dual imaging beams 94. Beams 94 are scanned across a moving photoreceptor 98 of Print Module 95 by the mirrored facets of a rotating polygon 100 to expose two image lines on photoreceptor 98 with each scan and create the latent electrostatic images represented by the image signal input to modulator 92. Photoreceptor 98 is uniformly charged by corotrons 102 at a charging station preparatory to exposure by imaging beams 94. The latent electrostatic images are developed by developer 104 and transferred at transfer station 106 to a print media 108 delivered by Paper Supply section 107. Media 108, as will appear, may comprise any of a variety of sheet sizes, types,and colors. For transfer, the print media is brought forward in timed registration with the developed image on photoreceptor 98 from either a main paper tray 110 or from auxiliary paper trays 112 or 114. Print media 108 is fed with the 11" dimension perpendicular to the direction of feed. Accordingly, variations in print media size are normally accommodated in the direction of sheet feed. For example, 8.5"×11" media is fed long edge first while 17"×11" media is fed short edge first. The developed image transferred to the print media 108 is permanently fixed or fused by fuser 116 and the resulting prints discharged to either output tray 118, or to finisher 120. Finisher 120 includes a stitcher 122 for stitching or stapling the prints together to form books and a thermal binder 124 for adhesively binding the prints into books.

Referring to FIGS. 1, 2 and 5–7, controller section 7 is, for explanation purposes, divided into an image input controller 50, User Interface (UI) 52, system controller 54, main memory 56, image manipulation section 58, and image output controller 60.

The scanned image data input from processor 25 of image input section 4 to controller section 7 is compressed by image compressor/processor 51 of image input controller 50 on PWB 70-3. As the image data passes through compressor/processor 51, it is segmented into slices N scanlines wide, each slice having a slice pointer. The compressed image data together with slice pointers and any related image descriptors providing image specific information (such as height and width of the document in pixels, the compression method used, pointers to the compressed image data, and pointers to the image slice pointers) are placed in an image file. The image files, which represent different print jobs, are temporarily stored in system memory 61 which comprises a Random Access Memory or RAM pending transfer to main memory 56 where the data is held pending use.

As best seen in FIG. 1, UI 52 includes a combined operator controller/CRT display consisting of an interactive touchscreen 62, keyboard 64, and mouse 66. UI 52 interfaces the operator with printing system 2, enabling the operator to program print jobs and other instructions, to obtain system operating information, instructions, programming information, diagnostic information, etc. Items displayed on touchscreen 62 such as files and icons are actuated by either touching the displayed item on screen 62 with a finger or by using mouse 66 to point cursor 67 to the item selected and keying the mouse.

Main memory 56 has plural hard disks 90-1,90-2, 90-3 for storing machine Operating System software, machine operating data, and the scanned image data currently being processed.

When the compressed image data in main memory 56 requires further processing, or is required for display on touchscreen 62 of UI 52, or is required by printer section 8, the data is accessed in main memory 56. Where further processing other than that provided by processor 25 is required, the data is transferred to image manipulation section 58 on PWB 70-6 where the additional processing steps such as collation, make ready, decomposition, etc. are carried out. Following processing, the data may be returned to main memory 56, sent to UI 52 for display on touchscreen 62, or sent to image output controller 60.

Image data output to image output controller 60 is decompressed and readied for printing by image generating processors 86 of PWBs 70-7, 70-8 (seen in FIG. 5). Following this, the data is output by dispatch processors 88, 89 on PWB 70-9 to printer section 8. Image data sent to printer section 8 for printing is normally purged from memory 56 to make room for new image data.

Referring particularly to FIGS. 5–7, control section 7 includes a plurality of Printed Wiring Boards (PWBs) 70, PWBs 70 being coupled with one another and with System Memory 61 by a pair of memory buses 72, 74. Memory controller 76 couples System Memory 61 with buses 72, 74. PWBs 70 include system processor PWB 70-1 having plural system processors 78; low speed I/O processor PWB 70-2 having UI communication controller 80 for transmitting data to and from UI 52; PWBs 70-3, 70-4, 70-5 having disk drive controller/processors 82 for transmitting data to and from disks 90-1, 90-2, 90-3, respectively, of main memory 56 (image compressor/processor 51 for compressing the image data is on PWB 70-3); image manipulation PWB 70-6 with image manipulation processors of image manipulation section 58; image generation processor PWBs 70-7, 70-8 with image generation processors 86 for processing the image data for printing by printer section 8; dispatch processor PWB 70-9 having dispatch processors 88, 89 for controlling transmission of data to and from printer section 8; and boot control-arbitration-scheduler PWB 70-10.

Referring particularly to FIG. 8, system control signals are distributed via a plurality of printed wiring boards (PWBs). These include EDN core PWB 130, Marking Imaging core PWB 132, Paper Handling core PWB 134, and Finisher Binder core PWB 136 together with various Input/Output (I/O) PWBs 138. A system bus 140 couples the core PWBs 130, 132, 134, 136 with each other and with controller section 7 while local buses 142 serve to couple the I/O PWBs 138 with each other and with their associated core PWB.

On machine power up, the Operating System software is loaded from memory 56 to EDN core PWB 130 and from there to the remaining core PWBs 132, 134, 136 via bus 140, each core PWB 130, 132, 134, 136 having a boot ROM 147 for controlling downloading of Operating System software to the PWB, fault detection, etc. Boot ROMs 147 also enable transmission of Operating System software and control data to and from PWBs 130, 132, 134, 136 via bus 140 and control data to and from I/O PWBs 138 via local buses 142. Additional ROM, RAM, and NVM memory types are resident at various locations within system 2.

Referring to FIG. 9, jobs are programmed in a Job Program mode in which there is displayed on touchscreen 62 a Job Ticket 150 and a Job Scorecard 152 for the job being programmed. Job Ticket 150 displays various job selections programmed while Job Scorecard 152 displays the basic instructions to the system for printing the job.

Figure 10A:
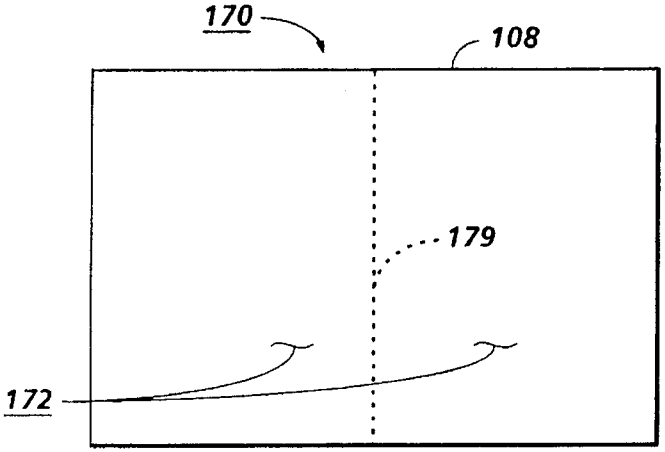
Figure 10B:
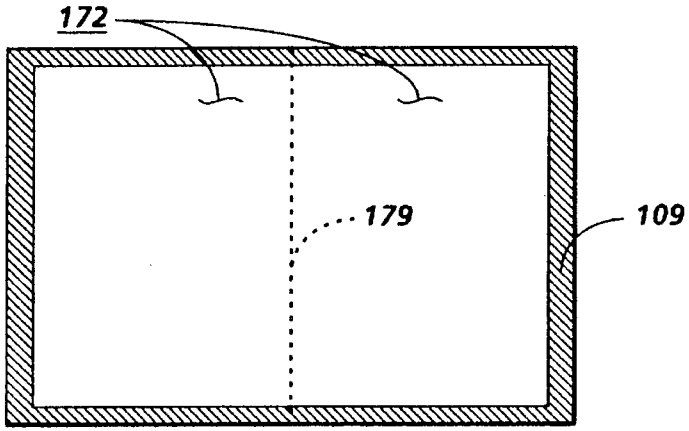

Referring to FIGS. 10A, 10B, and 11, as used herein, a signature 170 is one sheet of print media 108 having P pages 172, ½P pages on each side. A segment 174 is two or more signatures 170 assembled and folded at the centerline or foldline 179. A book 175 consists of two or more segments 174, each usually having the same number of signatures 170, assembled together. A set 173 is one copy of the finished product or signature document which can be a signature 170, a segment 174 or a book 175 (i.e., a brochure, newsletter, textbook, etc.).

As shown in FIG. 11, the signature imposition process of system 2 arranges the images so that the first and last pages printed are on the back side of the outermost signature 170-4 with the second and next to the last pages printed on the front side of the signature, the third and second from last pages printed on the back side of the next to the last signature 170-3 with the fourth and third from the last pages printed on the front side of signature 170-3, etc. In the examples shown in FIG. 11, 4 signatures 170 are folded and nested to provide a segment 174, with several segments combined to form a book 175.

Figure 10C:
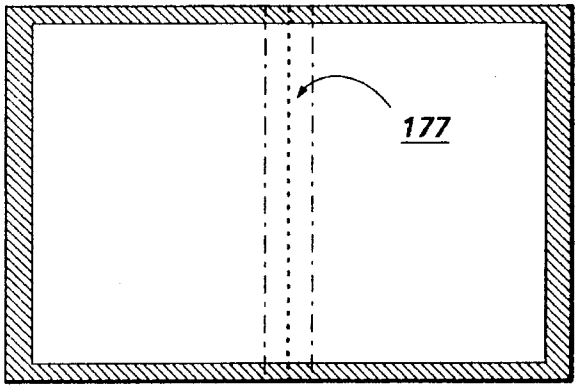
Figure 10D:
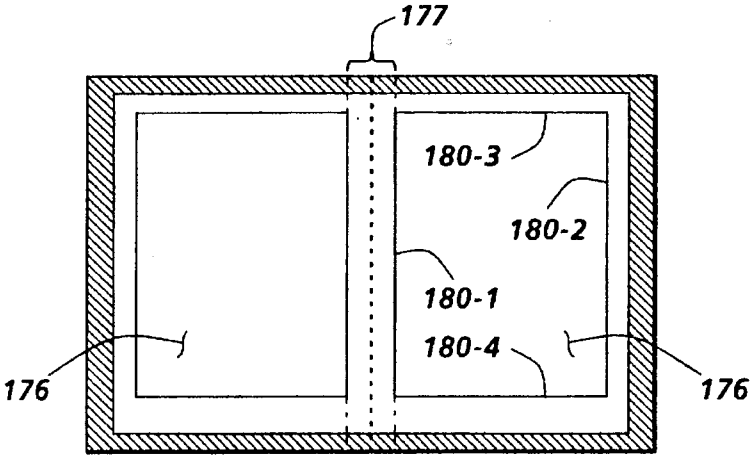

Referring also to FIGS. 10C and 10D, the area between the pages 172 of each signature 170 is referred to as the gutter 177. Signature foldline 179 is centered in gutter 177. The size, i.e. the width, of gutter 177 is determined by the inside margins 180-1 of the page frame 176 on each side of foldline 179. Inside, outside, top,and bottom margins 180-1,180-2, 180-3, and 180-4, which define a page frame 176, are used to determine the minimum gutter size necessary to prevent parts of the signature images from becoming obscured when the signatures 170 or segments 174 are assembled together.

Referring to FIG. 12, to program printing system 2 for a signature print job, the operator, using "Job types & Tickets" icon 149, accesses and displays a signature job ticket 150'. Signature Job ticket 150' has a series of default programming selections arranged in three columns or rows labeled "Job Level", "Basic", and "Special". A job scorecard 152', which can be displayed alongside job ticket 150', is provided for each of the "Job Level", "Basic" and "Special" selections. By using the scorecard, the operator can re-program the default selections. In the example shown in FIG. 12, the "Job Scorecard" for "Job Level" programming is displayed. Scorecard 152' has programming icons 182-1, 182-2, . . . 182-5 corresponding to the selections in the "Job Level" column on signature job ticket 150'.

Referring to FIG. 13, where, for example, it is desired to change the default setting for "Quantity", icon 182-3 on "Job Scorecard" 152' is actuated to display "Document Quantity" and "Print Quantity" keyboards 184, 186, respectively. Keys 187 of keyboard 184 are used to select the number of pages P (FIG. 10B) 172 in one set while keys 187 of keyboard 186 are used to input the number of sets to print, each set being identical. As explained, a set or completed signature document can consist of a signature 170 (i.e., a brochure), a segment 174 (i.e., a newsletter) or a book 175 (i.e., a textbook). In the last case, keys 187 of keyboard 186 indicate the number of copies of book 175 to print.

Where the operator desires to change the default setting and program different selections in the "Basic" and "Special" options, job scorecards for these selections are accessed in the manner described.

Referring to FIG. 14, where, for example, a different size, type, or color print media is desired, "Basic" scorecard 152" is actuated and displayed on touchscreen 62. "Basic" scorecard 152" has a series of icons 196-1,196-2, . . . 196-6 corresponding to the "Basic" signature programming selections displayed on job ticket 150' including a Paper Stock icon 196-2. Actuation of Paper Stock icon 196-2 displays the various size, type, and color print media selections available in the form of icons 197, 198, 199, respectively. Using icons 197, 198, 199, the size, type, and/or color print media for the signature job may be changed. When selection is completed, Paper Stock icon 196-2 is closed.

Referring now to FIGS. 10B and 15, where the overall size of the signature pages 172 are to be smaller than the print media on which signatures 170 are printed, "Trim Size" icon 196-3 is accessed to display on screen 62 an electronic sheet 200 representing the print media on which the signatures will be printed. There is also displayed signature foldline 179 and numbered scales 202, 204 along the bottom and side of the sheet 200. Width and height scrolling icons 206, 207 are displayed to enable the trim of the width and height of the sheet 200 displayed on touchscreen 62 to be changed. Windows 209, 210 display the current width and height selections in inches. Trim height is centered within the media unless otherwise specified by including an offset value. Commonly, trim width is centered within the media when a sheet is to be folded about the centerline as both sides are trimmed in one operation. When programming is completed, Trim Size icon 196-3 is closed.

Once set, the trim size of the print media becomes the physical output constraint since media 109 outside the trim border is cut off by a suitable trimmer (FIG. 16) when the signatures 170 reach the finishing stage. If trim size is not changed, the default setting, in which trim size is equal to the output signature size, is programmed. In the Xerox® DocuTech printing system, the trim for each signature in a signature set is programmed automatically by setting the trim for a single electronic representation of a signature, as shown in FIG. 15. In other words, once the controller 7 is aware of the desired trim size required for one signature, then it can size each of the images intended for use in developing a signature set.

Further details regarding the above-mentioned signature imposition process are described in now allowed U.S. patent application Ser. No. 07/589,941, the pertinent portions of which are incorporated herein. Additionally, the manner in which the resulting prints are delivered to an on-line finishing apparatus, such as a signature booklet maker, is described in U.S. Pat. Nos. 5,159,395 and 5,184,185, the pertinent portions of which are incorporated herein.

FIG. 16 is a schematic view of a Signature Booklet Maker (SBM) for on-line use with a printing system. The SBM 300 includes a saddle stitcher module 310, a folder module 312, and a trimmer module 314.

When large copy sheets (11×17 or A3) are signature printed, they are conveyed through and exit the duplex paper path short edge first, are fed from the printer 8 through bypass 316 and into SBM 300 short edge first. When small copy sheets (8½×11 inch or A4) are signature printed, they are conveyed through and exit the duplex paper path long edge first and are fed through bypass 316. If these smaller sheets are to be folded across their long edge by the SBM, they must be rotated 90° prior to insertion into the SBM. Accordingly, a sheet rotary 318 is provided in the sheet bypass 316 for rotating sheets 90°. The smaller sheets, of course, can also be folded across their short edge by the SBM. In this instance, the copy sheets fed long edge first are not rotated by sheet rotary 318.

Although a variety of well known rotators can be used, it is preferable to use a sheet rotator employing a single stepper motor which contacts one side of a sheet to selectively decrease the velocity of that side (while a constant velocity roller-operating at the sheet bypass speed-engages and maintains the opposite side of the sheet at a constant velocity) to cause the sheet to rotate. Particularly, the sheet rotator disclosed in U.S. Pat. No. 5,090,683 to Kamath et al., the pertinent portions of which are incorporated herein. The stepper motor is maintained at the constant sheet bypass velocity if it is not necessary to rotate the sheets. For example, it is also possible to feed 8½×11 inch sheets into the SBM long edge first (without rotating) to form pamphlets having a final dimension (after folding) of 4½×11 inches.

Signature-printed copy sheets are deflected through sheet bypass 316 (rotated by sheet rotator 318 if necessary) and received by saddle stitcher 310. The copy sheets are received on a receiving tray 322 after entering stitcher 310 from sheet bypass 316. The forward movement of the sheets is stopped by a movable gate 324. Gate 324 moves in the direction indicated by arrows 326 to stop the sheets, or permit the sheets to move downstream of saddle stitcher 310. When a booklet is to be formed from a plurality of signature-printed copy sheets, gate 324 remains in the position where it blocks the passage of copy sheets through saddle stitcher 310. Each sheet is stopped by gate 314, and then tapped by an aligner 328 to side register each sheet.

After every copy sheet in a set of copy sheets is stopped by gate 324 and side aligned by aligner 328, a movable edge tamper 330 is positioned at the trail edge of the aligned copy sheets. Trail edge tamper 330 moves in the directions indicated by arrows 332 to secure the copy sheets in position for stitching. Stitchers 334, which move in the directions indicated by arrows 336, move downward to stitch all the signature printed copy sheets in the set to form a stitched booklet. Stitching can include, for example, stapling. After being stitched, the bound set of signature-printed copy sheets is forwarded to folder 312. In order to forward sheets out of saddle stitcher 310, gate 324 is moved so as to unblock the sheet passage out of saddle stitcher 310. Additionally, a sheet conveyor is contacted with the bound set to convey the set out of stitcher 310. The sheet conveyor can comprise, for example, a set of rollers 338 which are selectively movable toward and away from each other to engage and drive or disengage and not drive the set of copy sheets. For one example of a saddle stitcher, see U.S. Pat. No. 4,595,187 to Bober, the pertinent portions of which are incorporated herein.

Folder 312 receives a set of bound signature-printed copy sheets, the forward motion of which is stopped by sheet stop 342, the sheet stop being adjustable in directions consistent with the arrows 344. The set of bound signature-printed copy sheets is then folded by a sheet folder. One type of sheet folder can include a vertically movable fold blade 346 which contacts the signature sheets at a central location thereof (where the signature-printed copy sheets are stitched) and forces the central portion of the set of sheets between folding rollers 348. Fold blade 346 moves in the directions indicated by arrows 350. Folding rollers 348 fold the set of signature-printed copy sheets and convey the set out of folder 312 to trimmer 314. For further details of folders using a fold blade and a pair of rollers see, for example, U.S. Pat. No. 4,905,977 to Vijuk, the pertinent portions of which are incorporated herein. Of course, other types of folders such as those disclosed in U.S. Pat. No. 5,076,556 to Mandel, the pertinent portions of which are incorporated herein, can alternatively be used to place folds in sets of documents.

After being folded, the set of signature-printed copy sheets are received on tray 354 of trimmer 314. The forward movement of the folded signature-printed set is stopped by movable sheet stop 356 (which moves in the horizontal direction, as indicated by arrows 358 or the vertical direction, as indicated by arrows 360). After being stopped, the uneven edges of the folded signature set are trimmed by the cutting blade of trimmer 362 which moves in the vertical direction as indicated by arrows 364. After being trimmed, the folded signature set (or booklet) is fed by rollers 366 out of trimmer 314 and onto a tray 370 or other type of stacking unit.

It is understood that the location of the various sheet stops can be adjustable so that the SBM can form signature booklets from copy sheets having a variety of sizes. It is also understood that other types of stitchers, folders and trimmers can be used with the present invention to form signature booklets.

It will be appreciated that the SBM modules can be modified to edge stitch standard (non-signature) jobs. Edge stitching is defined as placing one or more stitches along the short or long edge of a set (versus the saddle stitch position). To provide edge stitching with SBM equipment, the stitchers 334 are repositioned within the stitcher module and the folding and trimming modules are bypassed. Additionally, the SBM 300 can be outfitted with a hole punch device (not shown) for adding hole punches to both signature and non-signature jobs.

As the finishing parameters of a signature job are varied, it may become necessary to adjust certain finishing components of the SBM 300. In one example, such adjustment may be dictated as a result of using print media whose stock characteristics, such as size and weight, vary from those encountered normally by the SBM. In the preferred embodiment, the degree of adjustment required for the finishing components is accomplished through use of one or more set-up prints. A technique for developing and using such set-up prints is discussed immediately below.

Referring to FIGS. 17 and 18, a process for printing one or more set-up images, i.e. a finishing proof job, for use in adjusting the SBM 300, is shown. At step 374, the process is initiated when a job requiring a document finishing ("DF") device is received at or developed in the printing system 2. As can be appreciated from the discussion above, the job could have its source, for example, in the scanner 6 (FIG. 2) or from the network 5. It is determined, at steps 376 and 378, whether the DF device requires adjustment and whether the operator desires to have the adjustment performed with a a set-up image (finishing proof job). If the operator does not desire to use the set-up image (finishing proof job), then the job is printed forthwith at step 380.

It should be appreciated that the decision made at step 376 could be made automatically. In one example, a given finishing parameter, such as trim amount, inputted by the user could be compared to a finishing parameter, inputted previously, for another job. If the difference between the currently inputted finishing parameter does not differ significantly from the previously inputted finishing parameter, then there is no need to adjust the component of the DF device corresponding to the currently inputted finishing parameter.

If the operator desires to adjust the DF device with the finishing proof job, then, via step 382, a DF Adjustment Template Routine ("Routine") is transmitted from disk 56 (FIG. 2) to the system memory 61 (FIG. 5). The routine is a piece of software code which permits a bitmap to be generated with image data provided by the routine and a set of inputted values or finishing parameters. Essentially, the resulting bitmap will assume a test pattern or set-up image format similar to that shown in FIG. 19. It will be appreciated by those skilled in the art that the test pattern could be generated with various types of code. In one example, the lines of the set-up image could be generated with a set of line-drawing commands and/or composed using graphic elements. With the routine in the system memory, finishing parameters, such as trim size, are, via step 384, written to the routine. The finishing parameters can be communicated to the routine in a number of ways. In one example, the operator inputs data by use of touch video graphic icons on a touch screen. As will be recognized, a host of other inputs could be used to write the finishing parameters to the routine without altering the concept of the disclosed embodiment. Additionally, some or all of the finishing parameters could be obtained by reference to any other job stored in the system file or printer queue disposed in one of the disks 90 (FIG. 2). Further information regarding the system file and printer queue can be obtained by reference to U.S. Pat. No. 5,164,842 to Gauronski et al., the pertinent portions of which are incorporated herein. Along with inputted finishing parameters, the number of set-up images to be generated with the bitmap is entered at step 386.

After the finishing parameters have been written to the routine, a bitmap, with one or more tolerance bands and/or one or more targets, is generated at step 387. Finishing parameters may also be generated by default when data has not been provided for that parameter. For example, bits may be selectively processed to accommodate multiple trim lines and multiple foldlines, even though finishing parameters, calling for such lines, are not provided by the user. Moreover, hole punch indications and stitch targets may be generated by default. Once the bitmap of the set-up image is generated, the bitmap, incorporating the finishing targets and/or tolerance indicators, is transmitted to the printer 8 (step 388) so that it can generate (i.e. print) the page of the finishing proof job, showing each resulting tolerance band or target (step 390).

Referring still to FIG. 18, upon generating the finishing proof job, it is determined, by use of the routine, whether a customer is to be billed for the finishing proof job. Typically, booklet making is performed as a service for a customer by a service provider, such as a print shop operator or the like. Initially, at step 392, it is decided whether the service provider or the customer is to be billed for the finishing proof job. If the customer is to be billed for the finishing proof job, then a customer billing account number is assigned to the finishing proof job, and the customer is, via step 394, billed for the set-up images printed at a finishing proof job rate. In the event that the service provider decides not to bill the customer for the finishing proof job, then the corresponding cost is absorbed by way of step 396.

At step 400, a finishing operation is performed with the printed results of the finishing proof job. In one example, at least two identical set-up prints (collectively forming a finishing proof job) are folded, stitched together, trimmed and/or hole-punched. As the resulting signature set or booklet exits the DF device, it is examined (step 402) to determine, among other things, whether 1) the foldline is situated appropriately, 2) the stitches are with their corresponding targets, 3) the trim is within a preselected tolerance and 4) the hole punches are within their respective targets. It is also comprehended that in an alternate embodiment a finishing proof job may be based on multiple set-up images that are not identical to each other.

Referring to FIG. 19, further understanding of the tolerance bands and targets, and their role in adjusting the SBM 300, can be obtained. It should be appreciated that in the present application the broad term "target indicator" refers to, among other things, targets, tolerance bands, offset targets and the like. In particular, one of the set-up images, intended for use in the disclosed embodiment 404 includes 1) trim tolerance lines 406-1 and 406-2, 2) central foldline 408, 3) supplemental fold lines 410-1 and 410-2, stitch target zones 412-1 and 412-2 and hole punch target zones 414-1 and 414-2. In practice, the tolerance bands and targets can be examined manually or automatically. In the case of manual surveillance, the operator simply processes a job with the set-up images and evaluates the resulting booklet at output tray 370. On the other hand, automatic surveillance of the set-up images can be achieved through the use of a controller coupled with a set of sensors, such as a set of light reflective sensors, disposed strategically throughout the SBM 300. Referring again to FIG. 16, sensors 418, 420 and 422 are disposed in the SBM modules 312 and 314. The use of these sensors, and a discussion of embodiments for calibrating the SBM 300 automatically, will appear below.

If examination of the tolerance bands or targets indicates that adjustment of one or more finishing components is required, then the process proceeds to step 426. Referring to FIGS. 16 and 19, the operation of steps 402 and 426 will be explained by way of examples:

In one example, if, after trimming a booklet, the resulting trimmed edge does not fall within the lines 406-1 and 406-2, then the trimmer is adjusted by moving sheet stop 356 in a direction consistent with one of the arrows 358. In one example of operation, sensor 422 can facilitate the evaluation of the acceptability of the trim by detecting the presence of a first edge of the booklet and the presence of a single trim line. With this information the amount of trim can be detected by the controller 428. The current technique envisions other ways to measure trim amount with a test sheet. For example, the test sheet could be provided with one relatively thick trim target which would be partially trimmed away when the trimmer is properly adjusted.

In another example, if, after folding the booklet in half, the foldline is not centered between two equal portions, then the folding module is adjusted by moving the sheet stop 342 in a direction consistent with one of the arrows 344 to cause the fold to be centered. In one example of operation, sensors 420 can facilitate the evaluation of the acceptability of the foldline when the foldline is printed on what will become the outside of the folded set-up prints. When a thin line (representing the target for the actual foldline) is printed at the center of the outside of the set-up prints and the resulting prints are folded into a booklet, the printed line cannot be seen, by way of a top or bottom plan view, provided the foldline is centered properly. Accordingly, when the line is printed at the center on the outside of each set-up print, and the resulting booklet is passed under the sensors 420, the printed line will be sensed by the sensors 420 only if the actual fold line is off-center.

In one contemplated embodiment, the SBM 300 can be used to fold letters. In this case, the foldlines would be offset relative to the central foldline 408. Supplemental foldlines 410-1 and 410-2 can be used to evaluate the actual foldlines of a folded letter.

In yet another example, if, after stitching (or stapling) the set-up prints, the stitches do not fall within stitch target zones 412-1 and 412-2, the stitchers 334 are adjusted by moving the stitchers along a line perpendicular with the sheet upon which the drawing of FIG. 16 is printed (i.e., along a line consistent with one of the arrows 336). In one example of operation, the sensor 418 can be used to determine if the stitches fall within the stitch target zones. More particularly, the zones are delineated by lines 430-1,430-2, 430-3 and 430-4, the lines 430 being considerably thinner than the stitches. Accordingly, the locations of the stitches can be determined by sending information from the sensor 418, to the controller 428, regarding the positional relationship between the thinner tolerance lines 430 and the relatively thicker stitch. It should be appreciated that the stitch zones serve as tolerance limits for the stitch placement as detected by sensor 418 in that the sensor first expects to find two relatively thin lines (e.g. lines 430-1 and 430-2) followed by two relatively thick lines (i.e. the stitches), followed by two more relatively thin lines (e.g. lines 430-3 and 430-4) when the stitches are properly placed within the tolerance indicators. If, however, the sensor 418 sees two pairs of relatively thin lines (i.e. the two pairs of tolerance indicators) before (or after) it sees two relatively thick lines (i.e. the two staples) or sees one pair of thin lines immediately adjacent one pair of thick lines (indicating the stitches have fallen on or very close to the tolerance lines), then the controller 428 can detect that the stitches are placed incorrectly.

In automatic approaches to adjusting the SBM 300, it may be useful to place machine readable code, such as bar code, on the set-up image to indicate, among other things, that the corresponding set-up print(s) is part of a finishing proof job. In this manner, a finishing proof job can be transported from a printer to a finishing apparatus for calibration thereof. In one example of operation, the finishing apparatus reads the machine readable code, realizes that the job is to be used in adjusting the finishing apparatus and makes any necessary adjustments to various finishing components automatically. Automatic adjustment of finishing components is discussed in further detail below and the use of machine readable codes to facilitate operation of a printing machine is discussed in further detail in U.S. Pat. Nos. 4,716,438 (to Farrell), 4,757,348 (to Rourke et al.), 4,970,554 (to Rourke) and 5,243,381 (to Hube et al.), the pertinent portions of which are incorporated herein.

Referring to FIG. 20, a first embodiment of a system for adjusting the SBM 300 automatically is designated by the numeral 434. While the drawing of FIG. 20 shows an arrangement in which only one adjustable finishing component is controlled, it will be appreciated by those skilled in the art that the concept underlying the arrangement of FIG. 20 could be applied readily to the implementation of a multicomponent system, such as the SBM 300. In the illustrated embodiment of FIG. 20, the system control 54 (FIG. 2) is coupled with the SBM controller 428. In one example, a finishing parameter, such as the amount of trim to be trimmed from each print media sheet in a signature set is inputted to the system control with the user interface 52. In turn, the DF adjustment template routine discussed above is used to generate a bitmap, that, in one example, assumes the appearance of the set-up image of FIG. 19. The generated bitmap is then displayed on the screen 62 (FIG. 1) through employment of one of a plurality of bitmap displaying routines, an example of which can be found in U.S. Pat. No. 5,150,462 to Takeda et al., the pertinent portions of which are incorporated herein. Preferably, the displayed finishing parameter is then stored in a database, of the type disclosed by U.S. Pat. No. 5,170,340 to Prokop et al., the pertinent portions of which are incorporated herein, for access by the SBM controller 300. As will appear from the discussion below, signals, representative of the inputted finishing parameters, stored in the database serve as control signals for a mechanical drive system 436. It will be appreciated that in the SBM adjustment system of the first embodiment, the function of the SBM controller could be fulfilled by the system control 54 without altering the concept upon which the system of FIG. 20 is based.

Referring still to FIG. 20, the mechanical drive system 436 includes a stepper motor 438 coupled with a screw 440. An adjustable finishing component, such as the registration stop 356, is movably mounted to the screw 440. In operation, the stepper motor responds to a control signal transmitted from the SBM controller 428 to effect the horizontal travel of the stop 356 along the screw 440, if necessary. The amount of travel required can be determined by comparing a given control signal, whose magnitude varies as a function of a corresponding inputted finishing parameter, with a corresponding reference level stored at, for example, the SBM controller 428. The control signal could be developed by various means. In one example of trim control, a function, whose inputs would vary as a function of sheet length and amount of desired trim, could be used to develop the control signal. Comparable functions could be developed for stitching, folding or a host of other conceivable finishing operations. It should be apparent that mechanical drive systems, other than the one shown in FIG. 20, could be used to adjust the adjustable finishing component without altering the concept upon which the adjusting system 434 is based. For example, it is contemplated that the screw could be replaced with a rack and pinion arrangement or a pneumatic drive of the type shown in U.S. Pat. No. 5,163,265 to Darcy et al., the pertinent portions of which are incorporated herein.

Referring to FIG. 21, a second embodiment of a system for adjusting the SBM 300 automatically is designated by the numeral 444. The arrangement of FIG. 21 includes components which are common with those shown in FIGS. 2 and 16 as well as an intelligent drive 446 for adjusting the various finishing components of the SBM 300. In practice, the intelligent drive, which operatively couples the system control 54 with the modules 310, 312 and 314 (FIG. 16), comprises a servo motor control system in which one or more motors (not shown) are provided to position the stops and/or stitchers of the SBM while a CPU is provided to control the motors in response to a sensing arrangement (not shown). In this sensing arrangement, one or more sensors would be provided to each of modules 310, 312 and 314 for sensing the position of each adjusting mechanism (e.g., the respective positions of the stitchers 334, the stop 342 and the stop 56). Preferably, the operation of the SBM 300 is, for each module (referred to below as "finishing component i"), maintained in a linear range so that the operation of the finishing components i conform to the following relationship:

$$f(x_i)=mx_i+c_i$$

where, $x_i$=amount of adjustment made at system control 54 for a given finishing component, $f(x_i)$=amount of adjustment applied to SBM module component is a function of changes made in $x_i$, $c_i$=calibration constant for adjusted component i It is contemplated that once the value of $c_i$ is known, adjustments can be automatically made to the various modules of the SBM without further manual intervention. One approach to obtaining this calibration constant is to finish one or more set-up prints with the SBM 300 and evaluate the results with the scanner 6. As will be appreciated by those skilled in the art, the scanner can be configured readily to determine, among other things, whether the amount of trim is acceptable, the position of the foldline is appropriate and the stitches are within their respective target zones. In view of an evaluation performed with the scanner, suitable information is transmitted to the controller 428 after multiple iterations such that the calculation for $c_i$ can be made and thereby cause the drive to make any necessary adjustments to the SBM modules.

Numerous features of the above-described embodiment will be appreciated by those skilled in the art:

One feature of the disclosed embodiment is that it facilitates the automatic adjustment of an on-line finishing device. In one example, a control signal, representative of a finishing parameter is transmitted from a printing machine controller to a mechanical drive system in the finishing device. If the control signal varies substantially from a preselected reference level, then a finishing component of the on-line finishing device is adjusted.

Another feature of the disclosed embodiment is that it provides a portable approach for adjusting on-line and off-line finishers. In particular, operation of a given component in a finisher can be calibrated through use of a set-up print having target zones and tolerance bands disposed thereon. In one example, a pair of stitch targets, a proposed foldline and a trim tolerance band is printed on a plurality of test sheets, and the test sheets are finished as a booklet in a Signature Booklet Maker ("SBM"). In turn, the booklet is used to determine if the various components of the SBM are operating in a manner which provides acceptable finishing quality. With set-up prints of this sort, the acceptability of trim amount can be ascertained without reference to programmed values in the printer, and respective locations of the foldline and stitches are highlighted graphically for ease of sensing or viewing, thus eliminating the need for separate measurement tools (e.g. a ruler).

Another feature of the disclosed embodiment resides in the provision of a technique for determining when a finishing component in a finisher requires adjustment. This can be achieved by comparing a currently programmed finishing parameter value with a previously programmed finishing parameter value and determining whether the difference between the two values is greater than a preselected reference. In those cases where the difference is inconsequential, no adjustment is required.

What is claimed is:

1. A printing system having a finishing apparatus for receiving and processing a job, the finishing apparatus having an adjustable finishing component for performing a finishing operation on one or more print media sheets, comprising:

a controller for receiving a programmed finishing parameter which indicates a manner in which the job is to be finished, said controller converting the programmed finishing parameter into a set-up signal, the set-up signal varying as a function of the programmed finishing parameter;

a system for generating a set-up image with the set-up signal, the set-up image including a target indicator, the target indicator varying as a function of the programmed finishing parameter, wherein the target indicator includes a relative position in the set-up image;

an adjustment system for adjusting the adjustable finishing component with the set-up image, said adjustment system including a mechanical drive and a coupling device, said coupling device coupling said mechanical drive with the adjustable finishing component;, and wherein, said adjustment system generates a position signal representing a relative position of the adjustable finishing component in the finishing apparatus, the set-up signal is compared to the position signal to determine if a selected relationship exists between the relative position of the target indicator and the relative position of the adjustable finishing component, and said mechanical drive is actuated to move the adjustable finishing component in a selected direction, from a first point to a second point, when the selected relationship does not exist.

2. The printing system of claim 1, wherein the finishing operation includes a selected one of stitching a plurality of print media sheets together, folding one or more print media sheets and trimming portions of one or more print media sheets.

3. The printing system of claim 1, wherein the adjustable finishing component includes a selected one of a stitcher for stitching a plurality of print media sheets, a folder for folding one or more print media sheets and a trimmer for trimming selected portions of one or more print media sheets.

4. The printing system of claim 1, further comprising a user interface for programming the programmed finishing parameter.

5. The printing system of claim 4, wherein said user interface includes a screen for displaying the set-up image.

6. The printing system of claim 1, wherein:

the printing system includes a printing machine with the finishing apparatus coupled thereto; and said controller is disposed in said printing machine.

7. The printing system of claim 1, wherein the set-up image is printed to obtain a set-up print and the set-up print is used to determine whether a selected relationship exists between the relative position of the target indicator and the relative position of the adjustable finishing component.

8. The printing system of claim 7, further comprising a sheet transporter for transporting the set-up print to the finishing apparatus so that a finishing operation is performed on the set-up print with the adjustable finishing component, wherein the adjustable finishing component is adjusted when it is determined that the selected relationship does not exist.

9. A printing system having a finishing apparatus for receiving and processing a job, the finishing apparatus having an adjustable finishing component for performing a finishing operation on one or more print media sheets, the adjustable finishing component including a relative position in the finishing apparatus, comprising:

a controller for receiving a programmed finishing parameter which indicates a manner in which the job is to be finished, said controller converting the programmed finishing parameter into a set-up signal, the set-up signal varying as a function of the programmed finishing parameter;

means for generating a set-up image with the set-up signal, the set-up image including a target indicator, the target indicator varying as a function of the programmed finishing parameter, the target indicator including a relative position in the set-up image;

means for adjusting the adjustable finishing component with the set-up image;

wherein the set-up image is printed to obtain a set-up print and the set-up print is used to determine whether a selected relationship exists between the relative position of the target indicator and the relative position of the adjustable finishing component;

a sheet transporter for transporting the set-up print to the finishing apparatus so that a finishing operation is performed on the set-up print with the adjustable finishing component, wherein the adjustable finishing component is adjusted when it is determined that the selected relationship does not exist; and an evaluating apparatus for determining if the selected relationship exists.

10. The printing system of claim 9, wherein said evaluating apparatus includes a scanning device for scanning the set-up print to calibrate the printing system.

11. The printing system of claim 9, wherein the finishing parameter is represented by one or more lines disposed on the set-up image with said evaluating apparatus including a sensor, for sensing the relationship between the one or more lines, to determine if the selected relationship exists.

12. The printing system of claim 11, wherein said evaluating apparatus communicates with said controller so that a position signal, representing the relative position of the adjustable finishing component in the finishing apparatus, is fed back to said controller for determining whether a selected relationship exists between the set-up signal and the position signal.

13. A method of controlling a printing system having a finishing apparatus for receiving and processing a job, the finishing apparatus having an adjustable finishing component adapted to perform a finishing operation on one or more print media sheets, the adjustable finishing component including a relative position in the finishing apparatus, comprising the steps of:

converting a programmed finishing parameter, indicating a manner in which a job is to be finished with the finishing apparatus, into a set-up signal, the set-up signal varying as a function of the programmed finishing parameter;

generating a set-up image with the set-up signal, the set-up image including a target indicator, the target indicator varying as a function of the programmed finishing parameter, the target indicator including a relative position in the set-up image;

determining, with the set-up image, whether a selected relationship exists between the relative position of the target indicator and the relative position of the adjustable finishing component; and adjusting the adjustable finishing component with the set-up image when it is determined, with said determining, that the selected relationship does not exist, said adjusting including moving the adjustable finishing component in a selected direction, from a first point to a second point.

14. The method of claim 13, further comprising the step of programming the job with the finishing parameter.

15. The method of claim 14, wherein said programming step includes displaying the set-up image.

16. The method of claim 13, further comprising the step of performing the finishing operation by selecting at least one of the following steps:

stitching a plurality of print media sheets together, folding one or more print media sheets; and trimming portions of one or more print media sheets.

17. The method of claim 13, further comprising the steps of:

generating a position signal representing the relative position of the adjustable finishing component in the finishing apparatus; and comparing the set-up signal and the position signal to determine if a selected relationship exists between the relative position of the target indicator and the relative position of the adjustable finishing component.

18. The method of claim 13, in which the printing system includes a printing machine, with the finishing apparatus coupled thereto, further comprising the step of performing said converting step with the printing machine.

19. The method of claim 13, further comprising the steps of:

providing a mechanical drive; and coupling the mechanical drive with the adjustable finishing component.

20. The method of claim 13, further comprising the steps of:

producing a first set-up print of the set-up image; and determining, with the set-up print, whether the selected relationship exists between the relative position of the target indicator and the relative position of the adjustable finishing component.

21. The method of claim 20, further comprising the step of transporting the set-up print to the finishing apparatus so that the finishing operation is performed on the set-up print with the adjustable finishing component, wherein the adjustable finishing component is adjusted when it is determined that the selected relationship does not exist.

22. The method of claim 20, in which the first set-up print includes a trim line superposed thereon and the first set-up print is trimmed with the finishing apparatus, further comprising the step of assessing, by reference to the trim line, whether an amount of the first set-up print trimmed is within a preselected range.

23. The method of claim 22, in which a second trim line is disposed on the first set-up print adjacent the first trim line, wherein said assessing step includes determining the extent to which the second trim line is trimmed away by the finishing apparatus.

24. The method of claim 20, in which the first set-up print includes a representation of a foldline superposed thereon, further comprising the steps of:

folding the first set-up print into two portions of equal dimensions; and determining, with the folded first set-up print, whether the foldline representation is centered between the two portions.

25. The method of claim 20, in which the target indicator of the set-up image includes a zone designating where a stitching member is to be received, further comprising the steps of:

producing a second set-up print of the set-up image;

fastening the first and second set-up prints together with the stitching member; and determining whether the stitching member falls within the zone.

26. The method of claim 20, in which the first set-up print includes a plurality of representations of drilled hole targets superposed thereon, further comprising the step of assessing, with the finishing apparatus, whether the drilled hole target representations are positioned at preselected locations along the first set-up image.

27. A method of controlling a printing system having a finishing apparatus for receiving and processing a job, the finishing apparatus having an adjustable finishing component adapted to perform a finishing operation on one or more print media sheets, the adjustable finishing component including a relative position in the finishing apparatus, wherein the job is printed for a customer, comprising the steps of:

converting a programmed finishing parameter, indicating a manner in which a job is to be finished with the finishing apparatus, into a set-up signal, the set-up signal varying as a function of the programmed finishing parameter;

generating a set-up image with the set-up signal, the set-up image including a target indicator, the target indicator varying as a function of the programmed finishing parameter;

adjusting the adjustable finishing component with the set-up image;

producing a first set-up print of the set-up image;

determining, with the set-up print, whether a selected relationship exists between the relative position of the target indicator and the relative position of the adjustable finishing component; and billing the customer a first rate for prints made exclusively for the job; and billing the customer a second rate for prints produced from the set-up image, the second rate being different than the first rate.

28. A method of controlling a printing system having a finishing apparatus for receiving and processing a job, the finishing apparatus having an adjustable finishing component adapted to perform a finishing operation on one or more print media sheets, the adjustable finishing component including a relative position in the finishing apparatus, wherein the finishing parameter is represented by one or more lines disposed on the set-up print comprising:

converting a programmed finishing parameter, indicating a manner in which a job is to be finished with the finishing apparatus, into a set-up signal, the set-up signal varying as a function of the programmed finishing parameter;

generating a set-up image with the set-up signal, the set-up image including a target indicator, the target indicator varying as a function of the programmed finishing parameter;

adjusting the adjustable finishing component with the set-up image;

producing a first set-up print of the set-up image;

determining, with the set-up print, whether a selected relationship exists between the relative position of the target indicator and the relative position of the adjustable finishing component; and wherein said determining includes sensing the relationship between the one or more lines to determine if the selected relationship exists.

29. The method of claim 20, wherein said producing step includes printing machine readable code on the set-up image.

30. A method of claim 9 of controlling a printing system having a finishing apparatus for receiving and processing a job, the finishing apparatus having an adjustable finishing component adapted to perform a finishing operation on one or more print media sheets, comprising the steps of:

converting a programmed finishing parameter, indicating a manner in which a job is to be finished with the finishing apparatus, into a set-up signal, the set-up signal varying as a function of the programmed finishing parameter;

generating a set-up image with the set-up signal, the set-up image including a target indicator, the target indicator varying as a function of the programmed finishing parameter, wherein said generating step includes generating the set-up image by reference to a second job stored in the printing system; and adjusting the adjustable finishing component with the set-up image.

31. A method of controlling a printing system having a finishing apparatus for receiving and processing a job, the finishing apparatus having an adjustable finishing component adapted to perform a finishing operation on one or more print media sheets, comprising the steps of:

programming the printing system with a first finishing parameter value representative of a first finishing operation to be performed on a first job;

storing the first finishing parameter value;

programming the printing system with a second finishing parameter value representative of a second finishing operation to be performed on a second job;

determining a difference between the first finishing parameter value and the second finishing parameter value; and adjusting the adjustable finishing component when the difference between the first finishing parameter value and the second finishing parameter value is different than a preselected reference value.

32. The method of claim 31, further comprising the step of performing each of the first finishing operation and the second finishing operation by selecting at least one of the following steps:

stitching a plurality of print media sheets together, folding one or more print media sheets; and trimming portions of one or more print media sheets.

33. A printing system having a finishing apparatus for receiving and processing a job, the finishing apparatus having an adjustable finishing component for performing a finishing operation on one or more print media sheets, the adjustable finishing component including a relative position in the finishing apparatus, comprising:

a controller for receiving a programmed finishing parameter which indicates a manner in which the job is to be finished, said controller converting the programmed finishing parameter into a set-up signal, the set-up signal varying as a function of the programmed finishing parameter;

a system for generating a set-up image with the set-up signal, the set-up image including a target indicator, the target indicator varying as a function of the programmed finishing parameter, the target indicator including a relative position in the set-up image;

a system for adjusting the adjustable finishing component with the set-up image;

wherein the set-up image is printed to obtain a set-up print and the set-up print is used to determine whether a selected relationship exists between the relative position of the target indicator and the relative position of the adjustable finishing component; and an evaluating system for determining if the selected relationship exists.

* * * * *